US009280878B2

(12) United States Patent
Hirato

(10) Patent No.: US 9,280,878 B2
(45) Date of Patent: Mar. 8, 2016

(54) REEL BAND, REEL ASSEMBLY, AND GAMING MACHINE

(71) Applicants: Universal Entertainment Corporation, Koto-ku, Tokyo (JP); Aruze Gaming America, Inc, Las Vegas, NV (US)

(72) Inventor: Jun Hirato, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 138 days.

(21) Appl. No.: 14/260,573

(22) Filed: Apr. 24, 2014

(65) Prior Publication Data

US 2014/0339767 A1 Nov. 20, 2014

(30) Foreign Application Priority Data

Apr. 24, 2013 (JP) ..... 2013-091701
Apr. 24, 2013 (JP) ..... 2013-091702

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01); *G07F 17/3288* (2013.01)

(58) Field of Classification Search
CPC ..... G07F 17/34; G07F 17/3213
USPC ..... 273/143 R, 138.2; 463/20
See application file for complete search history.

(56) References Cited

U.S. PATENT DOCUMENTS 5,211,399 A * 5/1993 Howard ..... G07F 17/3213 273/143 R
5,580,055 A * 12/1996 Hagiwara ..... G07F 17/3211 273/143 R
6,926,606 B2 * 8/2005 Onuki ..... G07F 17/3202 273/143 R
7,316,395 B1 * 1/2008 Kromydas ..... G07F 17/3213 273/143 R
8,105,154 B2 1/2012 Okada

FOREIGN PATENT DOCUMENTS

GB 2092795 A * 8/1982 ..... G07F 17/3213
GB 2165387 A * 4/1986 ..... G07F 17/3213
GB 2183883 A * 6/1987 ..... G07F 17/3213
JP 2002078844 A * 3/2002
JP 2002136641 A * 5/2002
JP 2005245605 A * 9/2005

* cited by examiner

*Primary Examiner* — Benjamin Layno
(74) *Attorney, Agent, or Firm* — KMF Patent Services, PLLC; Kenneth M. Fagin, Esq.; S. Peter Konzel, Esq.

(57) ABSTRACT

In a reel band, the transmittance of the light emitted from a backlight is adjusted without using a sheet for decreasing the transmittance, and the reel band is decorated without resort to printing. A reel band M32 includes: a translucent base layer M320; a symbol print layer M322 laminated on an outer side of the base layer M320 with respect to a direction of a thickness of the base layer M320 to form a plurality of symbols 501; and a mesh pattern layer M321 having rough texture and laminated on a portion of the base layer which portion is different from portions on which at least the plurality of symbols 501 are formed when viewed from a direction in which the layer is laminated, the mesh pattern layer M321 including a shield area M3211 configured to attenuate applied light and a non-laminated area M3212 configured to pass applied light.

6 Claims, 34 Drawing Sheets

FIG.20

| SYMBOL CODE | FIRST ROW | SECOND ROW | THIRD ROW | FOURTH ROW | FIFTH ROW |
|---|---|---|---|---|---|
| 00 | BAR | BAR<br>BAR | BAR | BAR<br>BAR | BAR |
| 01 | 7 | 7 | 7 | 7 | 7 |
| 02 | BAR<br>BAR<br>BAR | BAR<br>BAR<br>BAR | BAR<br>BAR<br>BAR | BAR<br>BAR<br>BAR | BAR<br>BAR<br>BAR |
| 03 | | | | | |
| 04 | BAR<br>BAR | BAR | BAR<br>BAR | BAR | BAR<br>BAR |
| 05 | BAR<br>BAR<br>BAR | BAR<br>BAR<br>BAR | CHANCE | BAR<br>BAR<br>BAR | BAR<br>BAR<br>BAR |
| 06 | BAR<br>BAR | BAR | BAR<br>BAR | BAR | BAR<br>BAR |
| 07 | 7 | 7 | 7 | 7 | 7 |
| 08 | BAR<br>BAR | BAR | BAR<br>BAR | BAR | BAR<br>BAR |
| 09 | BAR | BAR<br>BAR | BAR | BAR<br>BAR | BAR |
| 10 | 7 | 7 | 7 | 7 | 7 |

FIG.24

SYMBOL CODE DETERMINATION TABLE

| RANDOM NUMBER | SYMBOL CODE |
|---|---|
| 0-ULIMIT0 | 00 |
| LLIMIT01-ULIMIT01 | 01 |
| LLIMIT02-ULIMIT02 | 02 |
| LLIMIT03-ULIMIT03 | 03 |
| LLIMIT04-ULIMIT04 | 04 |
| LLIMIT05-ULIMIT05 | 05 |
| LLIMIT06-ULIMIT06 | 06 |
| LLIMIT07-ULIMIT07 | 07 |
| LLIMIT08-ULIMIT08 | 08 |
| LLIMIT09-ULIMIT09 | 09 |
| LLIMIT10-ULIMIT10 | 10 |

340

341

342

348

FIG.25

| RANDOM NUMBER | | | | | | | SYMBOL CODE |
|---|---|---|---|---|---|---|---|
| NORMAL GAME | NORMAL GAME | ··· | FIRST CHANCE GAME | SECOND CHANCE GAME | ··· | EIGHTH CHANCE GAME | |
| COL NO.1 | COL NO.2 | ··· | COL NO.1 | COL NO.2 | ··· | COL NO.8 | |
| 0-XXX | 0-XXX | ··· | 0-XXX | 0-XXX | ··· | 0-XXX | 00 |
| XXX-XXX | XXX-XXX | ··· | XXX-XXX | XXX-XXX | ··· | XXX-XXX | 01 |
| XXX-XXX | XXX-XXX | ··· | XXX-XXX | XXX-XXX | ··· | XXX-XXX | 02 |
| XXX-XXX | XXX-XXX | ··· | XXX-XXX | XXX-XXX | ··· | XXX-XXX | 03 |
| XXX-XXX | XXX-XXX | ··· | XXX-XXX | XXX-XXX | ··· | XXX-XXX | 04 |
| XXX-XXX | XXX-XXX | ··· | XXX-XXX | XXX-XXX | ··· | XXX-XXX | 05 |
| XXX-XXX | XXX-XXX | ··· | XXX-XXX | XXX-XXX | ··· | XXX-XXX | 06 |
| XXX-XXX | XXX-XXX | ··· | XXX-XXX | XXX-XXX | ··· | XXX-XXX | 07 |
| XXX-XXX | XXX-XXX | ··· | XXX-XXX | XXX-XXX | ··· | XXX-XXX | 08 |
| XXX-XXX | XXX-XXX | ··· | XXX-XXX | XXX-XXX | ··· | XXX-XXX | 09 |
| XXX-XXX | XXX-XXX | ··· | XXX-XXX | XXX-XXX | ··· | XXX-XXX | 10 |

FIG.26

SYMBOL DETERMINATION TABLE

| SYMBOL | PROBABILITY |
|---|---|
| 7 | 1/XXX |
| | 1/XXX |
| BAR BAR BAR | 1/XXX |
| BAR BAR | 1/XXX |
| BAR | 1/XXX |
| CHANCE | 1/XXX |

360

361

368

FIG.27

PAYOUT TABLE

360

361

368

| SYMBOL | PAYOUT | PROBABILITY |
|---|---|---|
| BAR BAR BAR BAR BAR<br>BAR BAR BAR BAR BAR<br>BAR BAR BAR BAR BAR | 120 | 1/152043 |
| BAR BAR BAR BAR<br>BAR BAR BAR BAR<br>BAR BAR BAR BAR | 60 | 1/21481 |
| BAR BAR BAR<br>BAR BAR BAR<br>BAR BAR BAR | 30 | 1/537 |
| BAR BAR BAR BAR BAR<br>BAR BAR BAR BAR BAR | 90 | 1/20041 |
| BAR BAR BAR BAR<br>BAR BAR BAR BAR | 45 | 1/4163 |
| BAR BAR BAR<br>BAR BAR BAR | 15 | 1/172 |
| BAR BAR BAR BAR BAR | 60 | 1/18415 |
| BAR BAR BAR BAR | 30 | 1/2185 |
| BAR BAR BAR | 12 | 1/101 |
| ANY BAR ANY BAR ANY BAR ANY BAR ANY BAR | 15 | 1/146 |
| ANY BAR ANY BAR ANY BAR ANY BAR | 6 | 1/96 |
| ANY BAR ANY BAR ANY BAR | 3 | 1/8 |
| | 60 | 1/1560046480 |
| | 30 | 1/4369884 |
| | 15 | 1/31144 |
| | 6 | 1/454 |
| | 3 | 1/14 |
| | 1000 | 1/10415 |
| | 300 | 1/1037 |
| | 200 | 1/494 |

FIG.28

PROBABILITY OF WINNING BY COMBINATION OF "CHERRY" AND "7"

| SEQUENCE OF CHANCE MODE GAME | PROBABILITY OF "CHERRY" | PROBABILITY OF "7" | PROBABILITY OF CONTINUATION |
|---|---|---|---|
| FIRST GAME | - | 1/67.2 | 1/672.0 |
| SECOND GAME | 1/10.4 | 1/59.7 | 1/597.3 |
| THIRD GAME | 1/6.6 | 1/44.8 | 1/448.0 |
| FOURTH GAME | 1/4.9 | 1/41.8 | 1/418.1 |
| FIFTH GAME | 1/3.8 | 1/39.2 | 1/392.0 |
| SIXTH GAME | 1/3.7 | 1/29.4 | 1/294.0 |
| SEVENTH GAME | 1/2.6 | 1/23.2 | 1/232.3 |
| EIGHTH GAME | 1/1.5 | 1/9.5 | 1/94.5 |

PROBABILITY OF COMBINATION WITH "7" IN CHANCE MODE GAME

| SEQUENCE OF CHANCE MODE GAME | 777 | 7777 | 77777 |
|---|---|---|---|
| FIRST GAME | 1/32.8 | 1/67.2 | 1/672.0 |
| SECOND GAME | 1/29.1 | 1/59.7 | 1/597.3 |
| THIRD GAME | 1/21.9 | 1/44.8 | 1/448.0 |
| FOURTH GAME | 1/20.4 | 1/41.8 | 1/418.1 |
| FIFTH GAME | 1/19.1 | 1/39.2 | 1/392.0 |
| SIXTH GAME | 1/14.3 | 1/29.4 | 1/294.0 |
| SEVENTH GAME | 1/11.3 | 1/23.2 | 1/232.3 |
| EIGHTH GAME | 1/4.6 | 1/9.5 | 1/94.5 |

PROBABILITY RISES WITH PROGRESS OF CHANCE MODE GAME

REEL BAND, REEL ASSEMBLY, AND GAMING MACHINE

CROSS REFERENCE TO RELATED APPLICATION

The present application claims priority from Japanese Patent Application Nos. 2013-091701 and 2013-091702, both of which were filed on Apr. 24, 2013, the disclosure of which is herein incorporated by reference in its entirety.

BACKGROUND OF THE INVENTION

1. Field of the Invention

The present invention relates to a reel band, a reel assembly, and a gaming machine.

Conventionally, reel assemblies are provided in a gaming machine, and each reel assembly includes a reel having a reel band with a plurality of symbols. When a game is run, the reels of the reel assemblies are rotated and then stopped, to rearrange the symbols, and based on the rearranged symbols, its game result is determined. In such a gaming machine, effects for the reels are provided by displaying effect images on a transparent liquid crystal panel disposed in front of the reels (e.g., see U.S. Pat. No. 8,105,154).

In such a gaming machine, a backlight for illuminating the reel band is disposed inside each reel to improve the visibility of symbols. To prevent direct application of the light from the backlight to a player, a sheet for decreasing the transmittance of the light has been generally used for a reel band. Therefore, the only way to decorate the reel band was to print images on such a sheet.

In view of the above problems, an object of the present invention is to provide a reel band and a gaming machine including the reel band, in which reel band, the transmittance of light emitted from a backlight is adjustable without using a sheet for decreasing the transmittance, and decoration on the reel band is possible without resort to printing.

Further, the arrangement described in the U.S. Pat. No. 8,105,154, in which the transparent liquid crystal panel is provided and effects are provided by making control on the transparent liquid crystal panel, leads to an increase in cost. Therefore, for cost reduction, it has been desired to provide an effect which brings about a change on a reel without using the transparent liquid crystal panel.

In view of the above, another object of the present invention is to provide a reel assembly and a gaming machine including the reel assembly, which reel assembly enables a symbol whose display and non-display on a reel is switchable to be mounted in the reel assembly even if the reel is a mechanical reel.

SUMMARY OF THE INVENTION

A reel band according to an embodiment of the present invention includes: a translucent base layer; a symbol layer laminated on an outer side of the base layer with respect to a direction of a thickness of the base layer to form a plurality of symbols; and a mesh pattern layer having rough texture and laminated on at least a portion of the base layer which portion is different from portions on which the symbols are formed when viewed from a direction in which the layer is laminated, the mesh pattern layer including a shield area configured to attenuate light applied thereto and a non-laminated area configured to pass therethrough light applied thereto.

In the above structure, the symbol layer attached to the reel band is illuminated from the inside and outside of the reel band by illuminating light of a backlight and an illumination device which are generally provided, and this allows the plurality of symbol to be seen from the outside. Further, the mesh pattern layer including the shield area configured to attenuate the illuminating light and the non-laminated area configured to pass therethrough the illuminating light is laminated in a portion of the reel band where the symbols are not formed. Therefore, in the potion where the symbols are not formed, the transmittance of the illuminating light is adjusted depending on the area ratio of the shield area to the non-laminated area. Further, when the mesh pattern layer is illuminated, a shaded pattern caused by the difference in transmittance between the shield area and the non-laminated area further emerges on a no symbol area (area where the symbols are not formed) of the reel, thereby decorating the reel without resort to printing. Furthermore, even if deterioration or the like is caused by aging, for example, the translucency is ensured by the non-laminated area, thereby improving the lifetime of the reel assembly.

In an embodiment of the present invention, the shield area of the mesh pattern layer may be laminated by means of printing.

In this structure, the mesh pattern layer is laminated by means of printing, and therefore adjustment of the transmittance of the reel is easier.

A gaming machine according to an embodiment of the present invention includes a reel including the reel band described above, and a controller configured to rotate and stop the reel to rearrange the symbols, thereby showing a game result.

In the above structure, a pattern formed on the no symbol area of the reel by the shield area and the non-laminated area is visible from the outside when the reel is stopped, and this pattern functions as an effect provided when displaying the game result.

According to an embodiment of the present invention, the transmittance of the light emitted from the backlight is adjusted without using a sheet for decreasing the transmittance, and further, decoration on the reel band is possible without resort to printing.

A reel assembly according to an embodiment of the present invention includes: a reel including a reel band having a plurality of symbols; and a backlight configured to illuminate the reel from an inside of the reel. The reel band includes a translucent base layer, a symbol layer laminated on an outer side of the base layer with respect to a direction of a thickness of the base layer to form the symbols, and a mesh pattern layer having rough texture and laminated on a portion of the base layer which portion is different from portions on which at least the symbols are formed when viewed from a direction in which the layers are laminated, the mesh pattern layer including a shield area configured to attenuate light emitted from the backlight and a non-laminated area configured to pass therethrough light emitted from the backlight to an outside. On an innermost layer of the reel band, there is provided a three dimensional recessed part including a translucent recessed member and an show-through symbol, the recessed member being formed to be recessed in cross-section, an inner wall surface of the recessed member creating an internal space in cooperation with the reel band, the show-through symbol being formed three-dimensionally on the inner wall surface.

In the above structure, the symbol layer of the reel band is illuminated by the light emitted from the backlight and passing through the base layer, so that the symbols are visible from the outside. The mesh pattern layer including the shield area configured to attenuate the light emitted from the backlight and the non-laminated area configured to pass therethrough the light emitted from the backlight to an outside is laminated in a portion of the reel band where the symbols are not formed. Further, on the innermost layer of the reel band, provided is the three dimensional recessed part including the recessed member and the show-through symbol. The recessed member is formed to be recessed in cross-section, the inner wall surface of the recessed member creates the internal space in cooperation with the reel band, and the show-through symbol is formed three-dimensionally on the inner wall surface. Therefore, in the case where the backlight is turned off, the internal space of the recessed member is illuminated by the light emitted from an illumination or the like provided outside of the reel and passing through the mesh pattern layer, the transmittance of which light is adjusted depending on the area ratio of the shield area to the non-laminated area on the mesh pattern layer. Therefore, the internal space of the recessed member is darker than the outside of the reel. This makes it impossible or difficult to see, from the outside, the show-through symbol provided in the internal space. Meanwhile, in the case where the backlight is turned on, the internal space of the recessed member is illuminated by the backlight, and this makes it possible to see the show-through symbol from the outside. Accordingly, it is possible to mount a symbol of which display and non-display on the reel is switchable even if the reel is a mechanical reel.

According to an embodiment of the present invention, a gaming machine includes the reel assembly described above, and a controller configured to rotate and stop the reel to rearrange the symbols, thereby showing a game result, and configured to control the backlight.

In this structure, the show-through symbol which has been not displayed becomes visible by turning on the backlight in accordance with a game result indication provided when the reel is stopped, and this functions as an effect for the game result indication.

According to an embodiment of the present invention, it is possible to mount a symbol of which display and non-display on the reel is switchable even if the reel is a mechanical reel.

BRIEF DESCRIPTION OF THE DRAWINGS

FIG. 20 is a diagram showing an exemplary symbol code table designating the symbols on the outer circumference surfaces of the reels.

FIG. 24 is a diagram showing exemplary data fields of a symbol code determination table.

FIG. 25 is a diagram showing a field structure of a symbol code determination table in which a plurality of tables are integrated into a single table.

FIG. 26 is a diagram showing an exemplary symbol determination table.

FIG. 27 is a diagram showing an exemplary payout table.

FIG. 28 is a diagram showing probabilities of winning combinations associated with specific symbols, and is a table showing that probabilities are increased as the chance mode game continues.

DESCRIPTION OF THE PREFERRED EMBODIMENTS (Overview of Gaming Machine)

A gaming machine of the present embodiment is a slot machine 10 including a controller configured to execute, as a basic game, a slot game in which a plurality of symbols 501 are rearranged to obtain a game result. The slot machine 10 has reel assemblies M11 each including a reel M3 having thereon a plurality of symbols 501. The reels M3 are rotated and then stopped, to rearrange the symbols 501.

Figure 1:
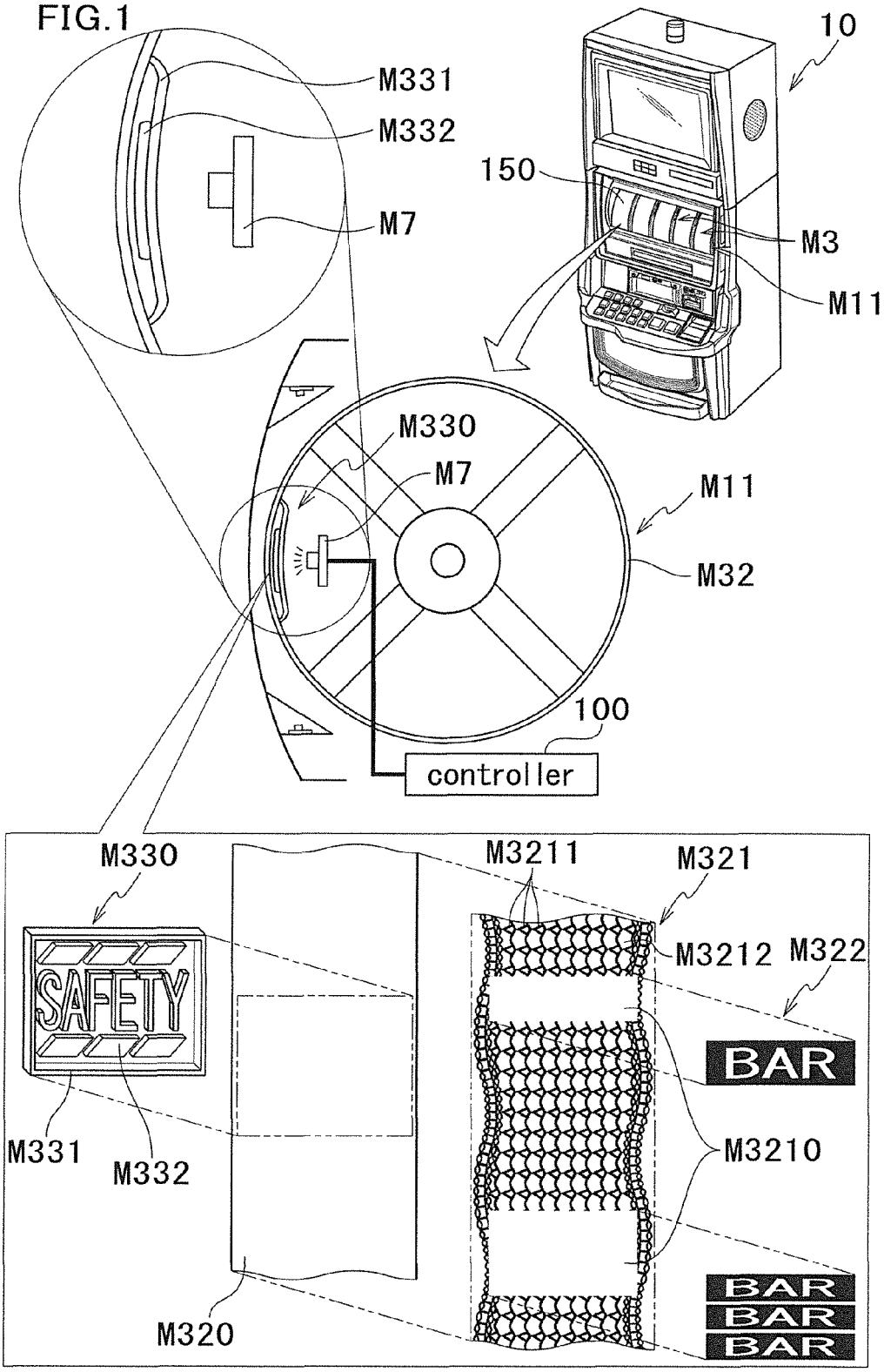
FIG. 1 is an explanatory diagram showing the structure of a reel band and a reel assembly.
Figure 2:
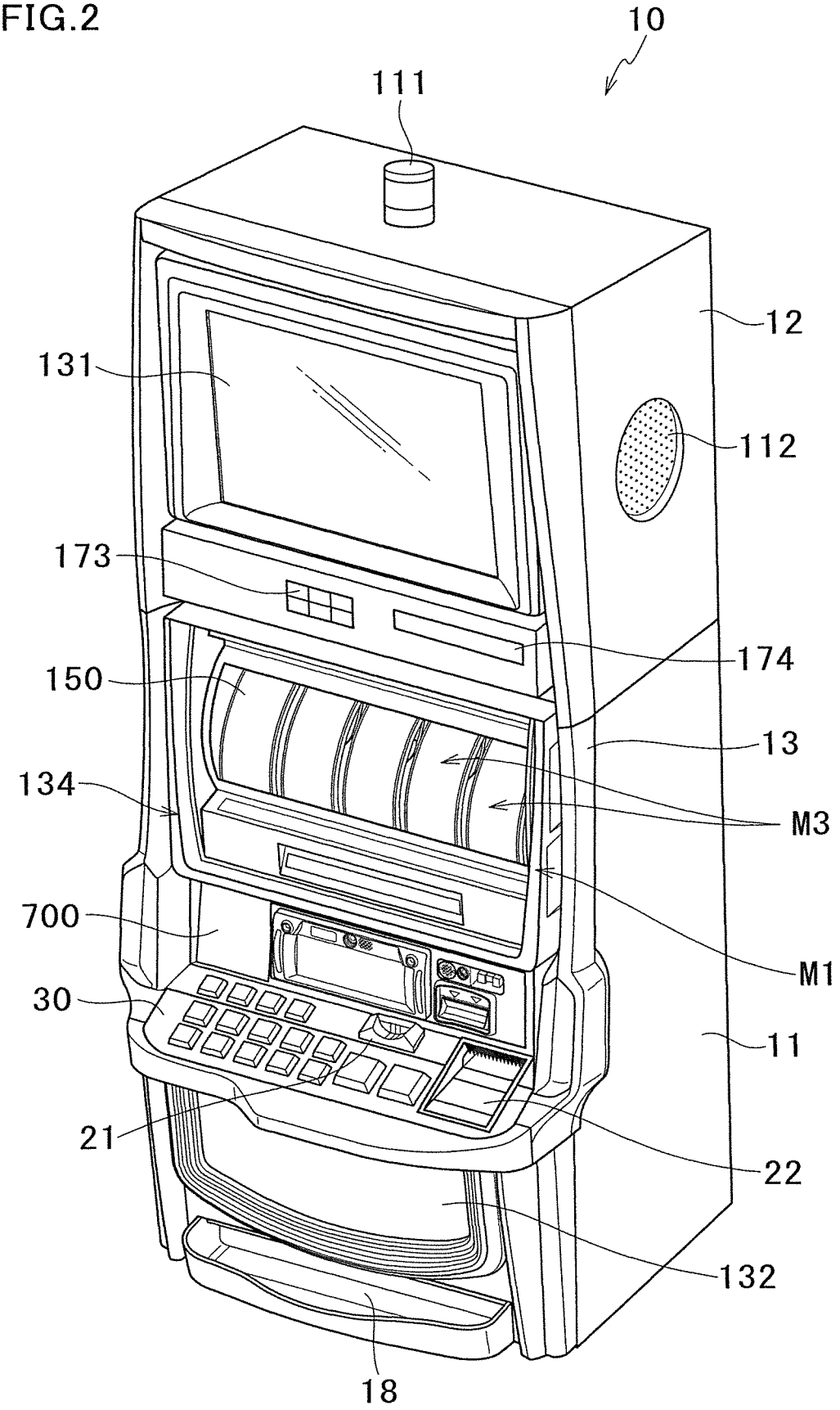
FIG. 2 is a perspective view showing an overall gaming machine.
Figure 3:
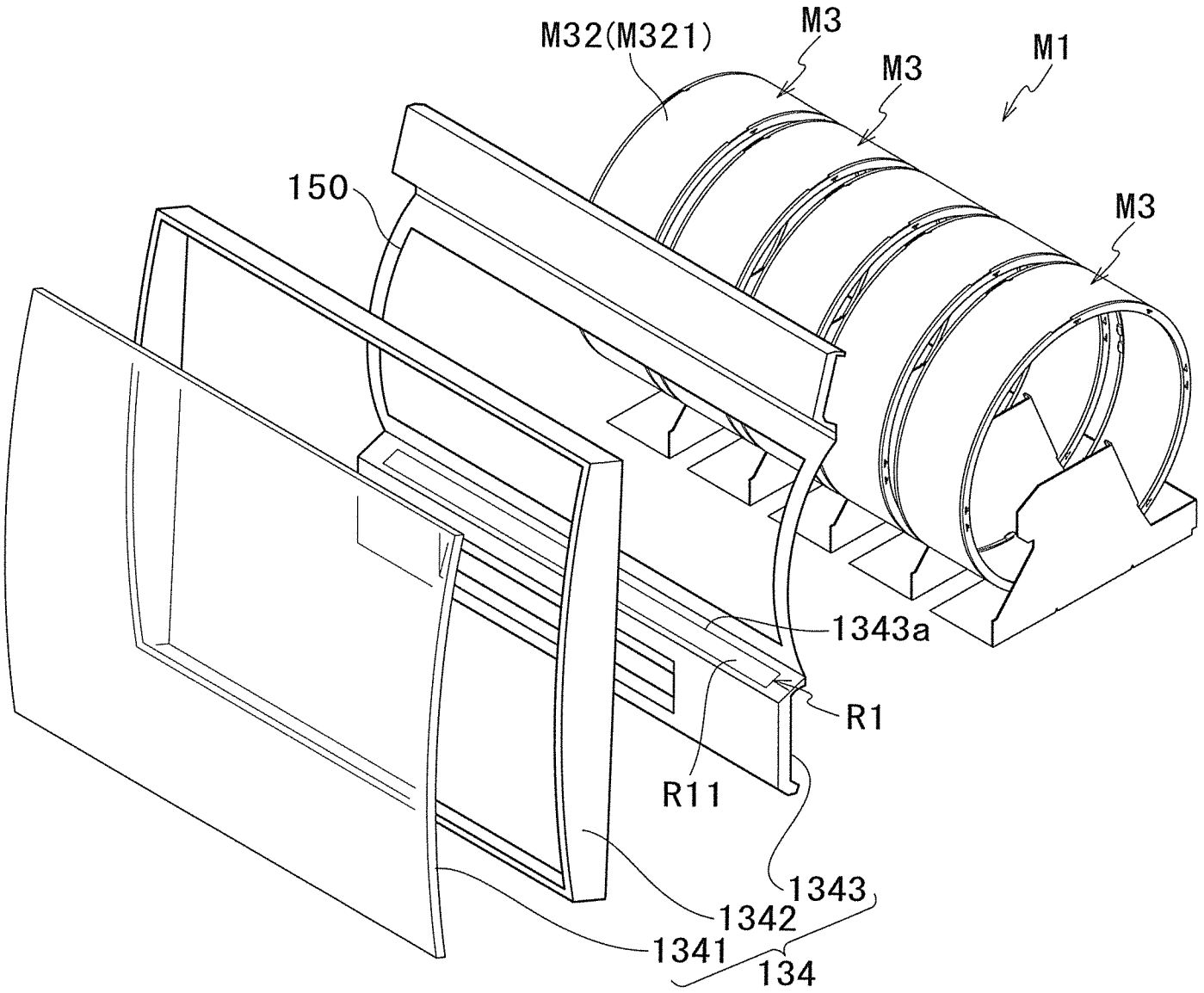
FIG. 3 is a perspective view of a reel device.

Specifically, as shown in FIGS. 1 to 3, each reel assembly M11 includes: the reel M3 having a reel band M32 having thereon the plurality of symbols 501; and a backlight unit M7 configured to illuminate the reel M3 from the inside thereof. The reel band M32 includes abase layer M320, a symbol print layer M322, and a mesh pattern layer M321. The base layer M320 is translucent. The symbol print layer (a symbol layer) M322 is laminated on an outer side of the base layer M320 with respect to the direction of the thickness of the base layer M320, to form the symbols 501. The mesh pattern layer M321 is laminated on a portion of the base layer M320 which portion is different from portions on which at least the symbols 501 are formed (those portions are symbol-formed areas M3210) when viewed from a direction in which the layer is laminated. The mesh pattern layer M321 is formed to have rough texture. That is, the mesh pattern layer M321 includes shield areas M3211 configured to attenuate the light from the backlight unit M7; and non-laminated areas M3212 configured to pass the light from the backlight unit M7 therethrough to the outside. Turning on and off of the backlight unit M7 is controlled by a controller 100 configured to rearrange the symbols 501.

The reel assembly M11 further includes, on the innermost layer of the reel band, a three dimensional recessed part M330 including a translucent recessed member M331 and a show-through symbol M332 (a symbol configured to be visible through the reel band M32). The recessed member M331 is formed to be recessed in cross-section, and an inner wall surface of the recessed member M331 creates an internal space in cooperation with the reel band M32. The show-through symbol M332 is formed three-dimensionally on the inner wall surface.

Here, the "rough texture" means that the surface of the mesh pattern layer provides a feel of roughness formed by the shield areas M3211 and the non-laminated areas M3212. Although the pattern for the rough texture is a mesh pattern in this embodiment, the pattern is not limited to this. For example, it may be a repeated pattern such as a striped pattern, checkered pattern, a pattern of a honeycomb structure, and a pattern of a punching hole mesh structure. A non-repeated pattern is also possible, such as patterns with a lace motif, a ribbon bow motif, and a floral motif. Further, a pattern made by a combination of two or more of the above is also possible.

The symbol print layer M322 on the reel band M32 is illuminated by the light having emitted from the backlight unit M7 and passing through the base layer M320, and this enables the symbols 501 to be seen from the outside. Further, in the portion where the symbols are not formed (the portion other than the symbol-formed areas M3210), the transmittance of the light emitted from the backlight unit M7 is adjusted depending on the area ratio of the shield areas M3211 to the non-laminated areas M3212. Further, when the mesh pattern layer M321 is illuminated by the backlight unit M7, a pattern formed by the shield areas M3211 and the non-laminated areas M3212 emerge on the portion of the reel M3 where the symbols 501 are not formed. With this, decoration is made without resort to printing. That is, the shield areas M3211 block the light emitted from the backlight unit M7, while the non-laminated areas M3212 passes therethrough the light emitted from the backlight unit M7. Therefore, the shape of the shield areas M3211 emerges and becomes visible when illuminated.

In the case where the backlight unit M7 is turned off, the internal space of the recessed member M331 is illuminated by the light emitted from the illumination or the like provided outside the reel M3 and passing through the mesh pattern layer, the transmittance of which light is adjusted depending on the area ratio of the shield areas M3211 to the non-laminated areas M3212 on the mesh pattern layer. Therefore, the internal space of the recessed member M331 is darker than the outside of the reel M3. This makes it impossible or difficult to see, from the outside, the show-through symbol M332 provided in the internal space. Meanwhile, in the case where the backlight unit M7 is turned on, the internal space of the recessed member M331 is illuminated by the light emitted from the backlight unit M7, and therefore the show-through symbol M332 in the internal space is visible through the reel band M32. Accordingly, it is possible to mount a symbol of which display and non-display on the reel is switchable even if the reel is a mechanical reel.

In the present embodiment, the mesh pattern layer M321 is laminated on the base layer M320 through screen printing, offset printing, or the like. This makes it easier to adjust the transmittance through the reel. Note that, the manner of lamination is not limited to the above. The mesh pattern layer M321 may be laminated by attaching, to the base layer M320, a piece of metal mesh, punching hole metal, cloth (e.g., hemp cloth), lace, ribbon, or the like. In this case, there may be provided an adhesive layer to adhere the mesh pattern layer M321 to the base layer M320. In the case where the adhesive layer is provided, it is preferable to use a light-transmissive resin.

Each shield area M3211 is not limited to a light shielding member. The shield area M3211 may be any member as long as the shield area M3211 at least attenuates the light emitted from the backlight unit M7. Further, in the case where an illumination device which illuminates the reels M3 from the outside thereof, it is preferable to set the illumination device and the backlight unit M7 so that the amount of light emitted from the backlight unit M7 and passing through the mesh pattern layer is larger than the amount of light from the illumination device. This improves the visibility of the show-through symbol M332.

Although the gaming machine in the present embodiment is the slot machine 10 itself which is for a single player, the gaming machine may be a group of slot machines 10 for multiple players. That is, the gaming machine may be a multiple-player type gaming machine including a plurality of slot machines 10 and a center controller connected to the slot machines 10 in such a manner that data communication is possible. This enables running of a basic game such as a slot game independently in each of the slot machines 10, and enables running of a common game by synchronizing the slot machines 10 with each other. Thus, the slot machine 10 is capable of functioning as a game terminal of the gaming machine. In this case, the connection between the slot machines 10 and the center controller may be wired or wireless, or may be a combination of these. The unit of the bet amount may be a national or regional currency such as Dollar, Yen, Euro, or a game point used only in the field or halls having the gaming machine. The number of the symbols 501 may be any given number of one or more. Further, the symbol 501 may be formed throughout the entire circumference of each reel M3, or may be formed a part of the entire circumference.

Rearrangement of symbols 501 in the slot game is executed by a reel device M1 (symbol display device) controlled by a controller 100. The slot game includes a process of running a normal game of rearranging the symbols 501 on the reel device M1 on condition that a gaming value is bet and awarding a normal payout based on the rearranged symbols 501, and a process of running a bonus game of rearranging symbols 501 with the assumption that the payout rate is higher than that of the normal game when the rearranged symbols 501 achieve a predetermined condition in a normal game and awarding a bonus payout based on the rearranged symbols 501.

The number and types of the "symbols 501" are not limited provided that the symbols 501 are rearranged in the reel device M1. The symbols 501 are superordinate concept of the specific symbols and normal symbols. The specific symbols are added to the normal symbols as needed. For example, the specific symbols include wild symbols and trigger symbols The wild symbol can be used as a substitute for any type of the symbol 501. Each trigger symbol is a symbol that serves at least as a trigger to start the bonus game. For example, in the present embodiment, the trigger symbol is "Chance Cherry" The trigger symbol may function as a trigger of increase in the number of the specific symbols in the bonus game, i.e., increase in the number of the specific symbols of at least one of the trigger symbols and the wild symbols. Furthermore, the trigger symbol may function as a trigger of increase in the number of times to run the bonus game.

A coin, a bill, or electrically valuable information corresponding to these is used as a gaming value. It is to be noted that the gaming value in the disclosure is not limited to these, and for example a medal, token, electric money, a ticket or the like can be adopted. The ticket may be a later-described ticket with a barcode.

The bonus game is equivalent to a feature game. While the bonus game in the present embodiment is described as games repeating a free game, the bonus game is not limited to them but is any type of game as long as the gaming state is more advantageous than that of the normal game. Other types of the bonus game may be employed as long as the gaming state is advantageous for the player, i.e., the gaming state is more advantageous than that of the normal game. For example, in the bonus game, various states such as a state in which more gaming values can be achieved as compared to the normal game, a state in which the probability of obtaining a gaming value is higher than the probability in the normal game, and a state in which the number of consumed gaming values is smaller than in the normal game are achieved independently or in combination.

A free game is a game which is executable with a smaller amount of gaming values bet than in the normal game. The expression "executable with a smaller amount of gaming value bet" includes a case where an amount of gaming values bet is zero. Therefore, the free game may be a game which is run without betting a gaming value and the gaming value is paid out for an amount corresponding to rearranged symbols 501. In other words, the free game may be a game that starts even if no gaming value is consumed. On the other hand, the normal game is run on condition that a gaming value is bet, and is a game of paying out gaming value for an amount corresponding to rearranged symbols 501. In other words, the normal game is a game that starts with the consumption of the gaming value.

The term "rearrangement" means rotate displaying the symbols 501 and then stop displaying them. In other words, the term indicates that the symbols 501 are rearranged after the arrangement of the symbols 501 is dismissed. The term "arrangement" indicates a state in which the symbols 501 are visually recognizable by an external player.

The phrase "normal payout based on the rearranged symbols 501" indicates a normal payout corresponding to a winning combination resulting from the rearrangement. The phrase "bonus payout based on the rearranged symbols 501" indicates a bonus payout corresponding to a winning combination resulting from the rearrangement. It is noted that the term "winning combination" indicates that a prize is established.

Examples of "a condition in which the payout rate is higher than in the normal game" include the execution of a free game, increase in the number of the wild symbols or the trigger symbols, and the execution of a game using another symbol table.

(Mechanical Structure of Slot Machine)

Referring to FIG. 2, the overall structure of the slot machine 10 will be described.

A coin, a bill, or electrically valuable information corresponding to these is used as a game medium in the slot machine 10. In the present embodiment, in particular, credit-related data such as money data stored in an IC card 500 is used.

The slot machine 10 includes a cabinet 11, a top box 12 installed on the upper side of the cabinet 11, and a main door 13 provided at the front surface of the cabinet 11.

Figure 4:
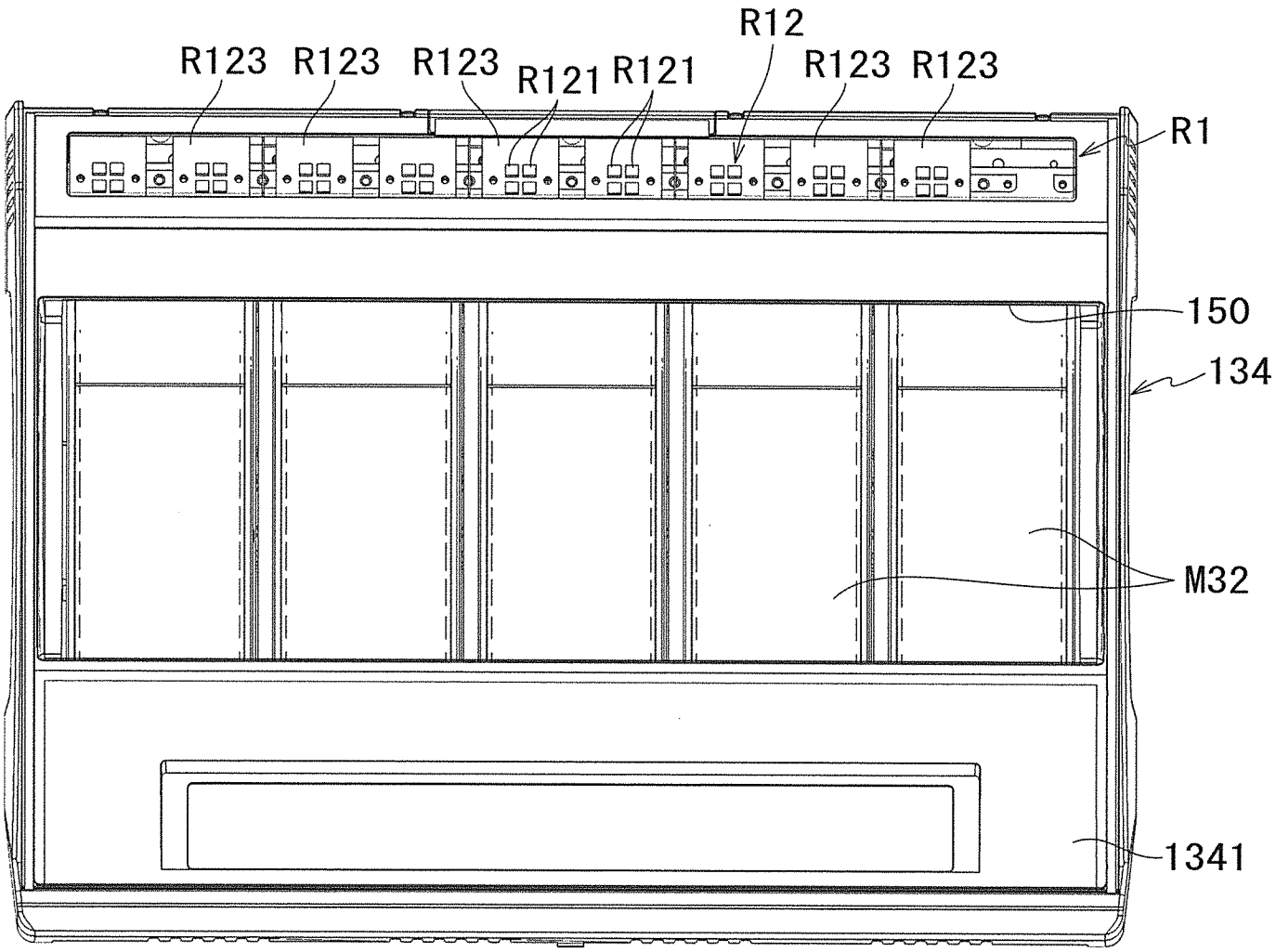
FIG. 4 is a front view of a reel cover.
Figure 5:
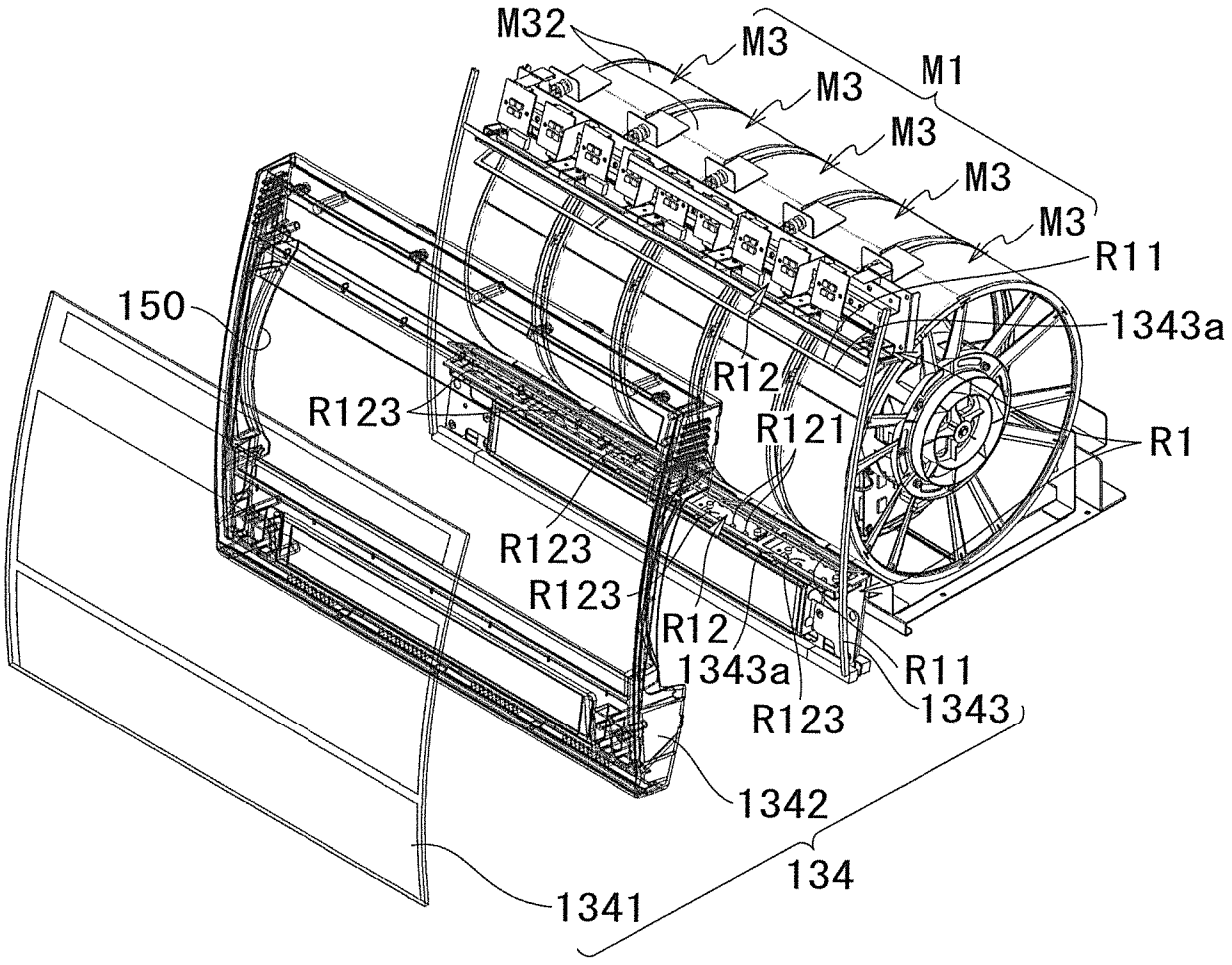
FIG. 5 is an exploded perspective view showing the reel device and the reel cover.
Figure 6:
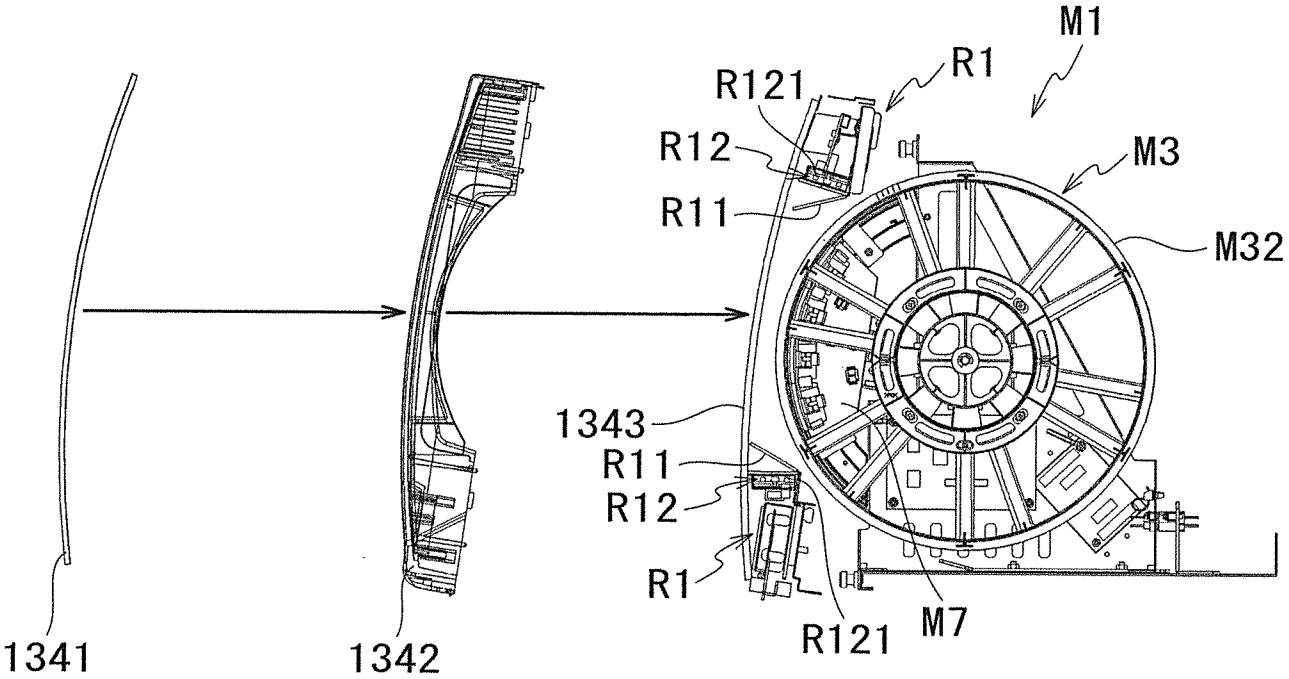
FIG. 6 is an exploded view of the reel device and the reel cover.
Figure 7:
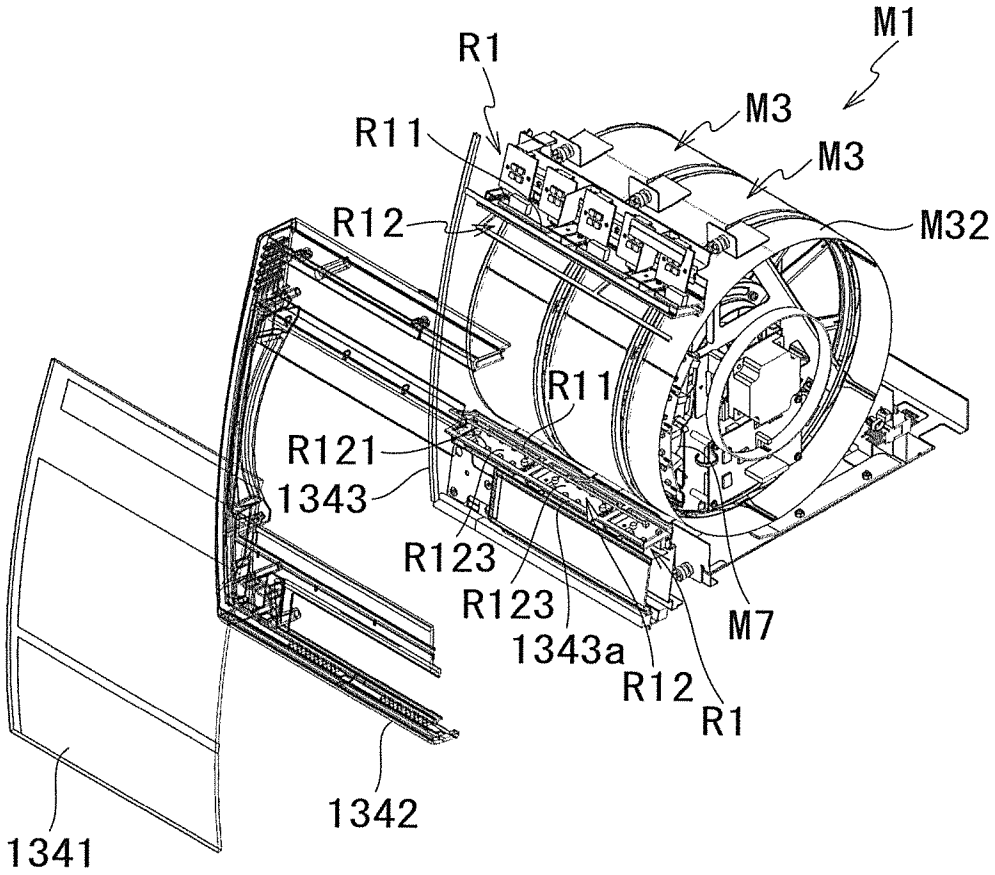
FIG. 7 is an exploded perspective view of a part of the reel device and the reel cover.
Figure 8:
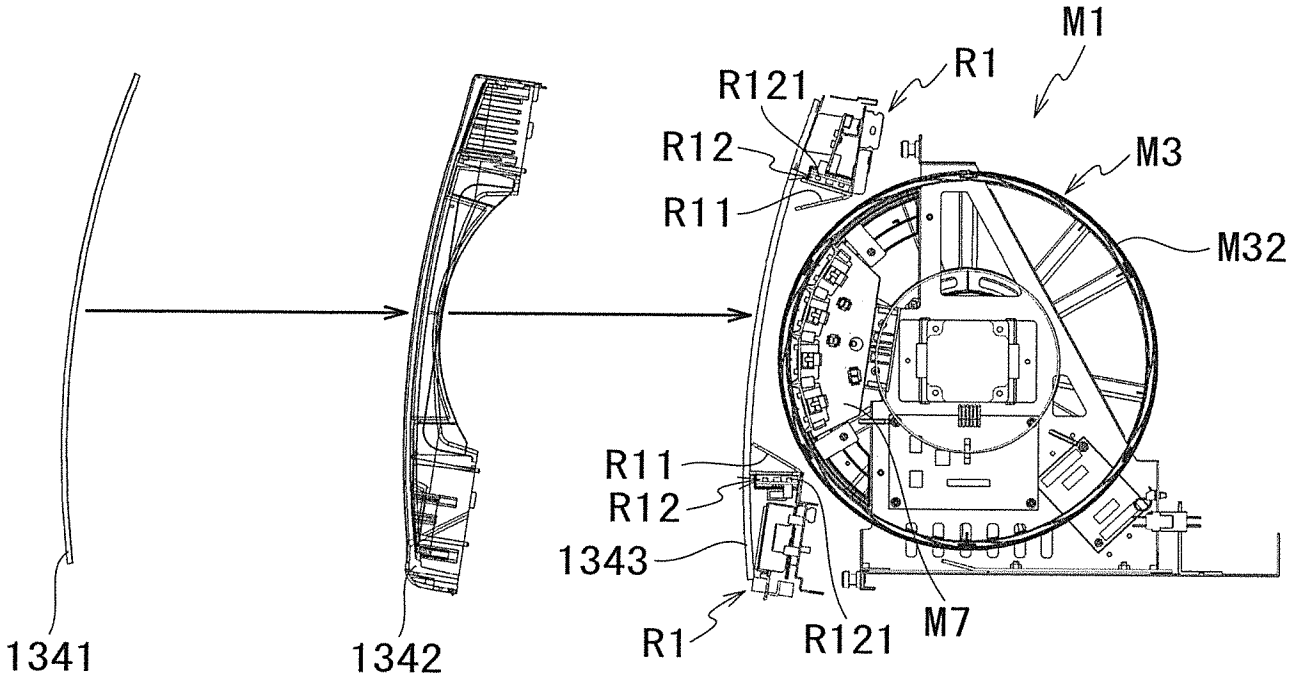
FIG. 8 is an exploded view of the reel device and the reel cover.
Figure 9:
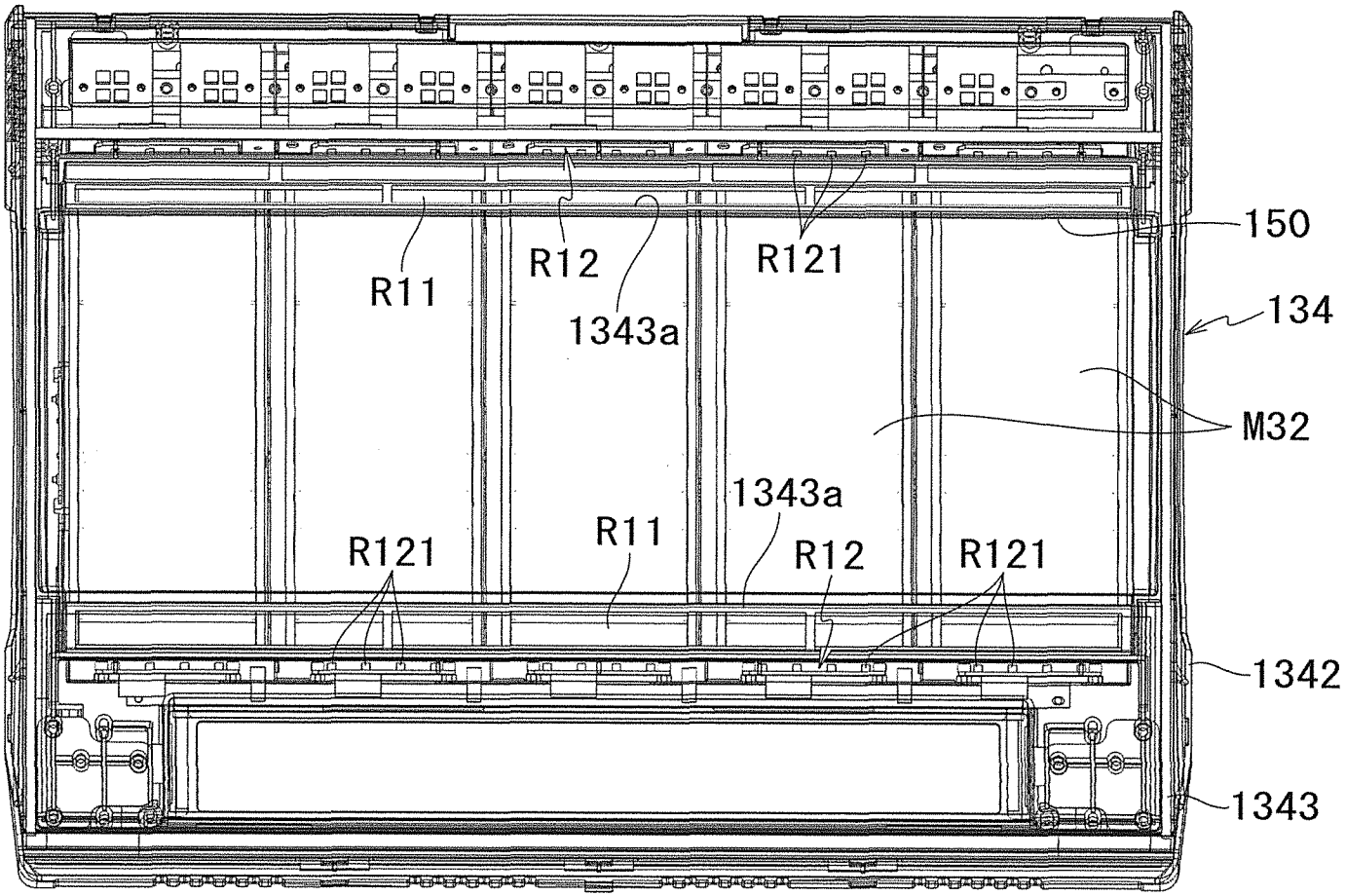
FIG. 9 is a front view of the reel cover.

The main door 13 is provided with a reel device M1. In front of the reel device M1 is provided a reel cover 134. As shown in FIG. 3 to FIG. 9, the reel cover 134 has a transparent panel 1341, a panel frame 1342 having the transparent panel 1341 on its front, and a panel supporter 1343 supporting the panel frame 1342. The panel supporter 1343 is provided with a light application device R1. As shown in FIG. 5 and FIG. 7, the light application device R1 includes a translucent panel R11 provided at an opening 1343*a* of the panel supporter 1343, and a light source R12 configured to emitting illuminating light. The light application device R1 is detailed later.

As shown in FIG. 2, the reel cover 134 has a display window 150 at its center portion. The display window 150 is configured so that fifteen symbols 501 of five columns and three rows are visible from the outside. Three symbols 501 in each column are a part of a symbol group arranged on the outer circumference surface of the reel M3. On each reel M3, the three symbols 501 thereon are moved downward or upward, while changing the overall speed. This enables rearrangement of the symbols 501 displayed, by stopping them after rotating them longitudinally.

On the reel cover 134, a touch panel may be provided. In this case, the player is able to input various instructions by operating the touch panel. The input signal is transmitted from the touch panel to the controller 100. Further, the reel cover 134 may have a transparent liquid crystal panel instead of the transparent panel 1341. Adopting the transparent liquid crystal panel enables effects which are in combination of the symbols on the reel device M1, the show-through symbol M332 of each three dimensional recessed part M330, and an effect image displayed on the transparent liquid crystal panel.

Below the reel device M1 is arranged a control panel 30. The control panel 30 is provided with buttons, a coin entry 21 for inserting coins into the cabinet 11, and a bill entry 22.

On the lower front surface of the main door 13, i.e., below the control panel 30, a coin receiving slot 18 for receiving coins, and a belly glass 132 on which a character of the slot machine 10 or the like is depicted are provided.

On the front surface of the top box 12 is an upper image display panel 131. The upper image display panel 131 is made of a liquid crystal panel, and structures a display. The upper image display panel 131 displays an image related to an effect, an image to introducing the game or explaining the rules of the game. Further, the top box 12 is provided with a speaker 112 and a lamp 111. In the slot machine 10, an effect is provided in the form of displaying an image, output of a sound, and output of light.

Below the upper image display panel 131 are provided a data displayer 174 and a keypad 173. The data displayer 174 includes a fluorescent display and/or an LED. For example, the data displayer displays member data read from an IC card 500 via a PTS terminal 700, or data input by the player by the keypad 173. The keypad 173 is for inputting data.

The PTS terminal 700 is provided below the reel device M1 in the slot machine 10. The PTS terminal 700 is a unit in which an LCD, a microphone, etc. are integrated. The PTS terminal 700 is connected to the game controller 100. The PTS terminal 700 has, for example, a function of executing an effect for a game by mutual communications with the game controller 100. When receiving game credit data from the PTS terminal 700, the controller 100 updates the credit display on the upper image display panel 131. Furthermore, the game controller 100 outputs settled credit data to the PTS terminal 700 when the credits on a game are settled. A management server may be connected to the PTS terminal 700 of each of the slot machines 10 to be able to communicate each other. This enables the management server to centrally manage the download of images for the PTS terminals 700, and IC cards and credits of the respective PTS terminals 700.

(Reel Device M1)

Figure 10:
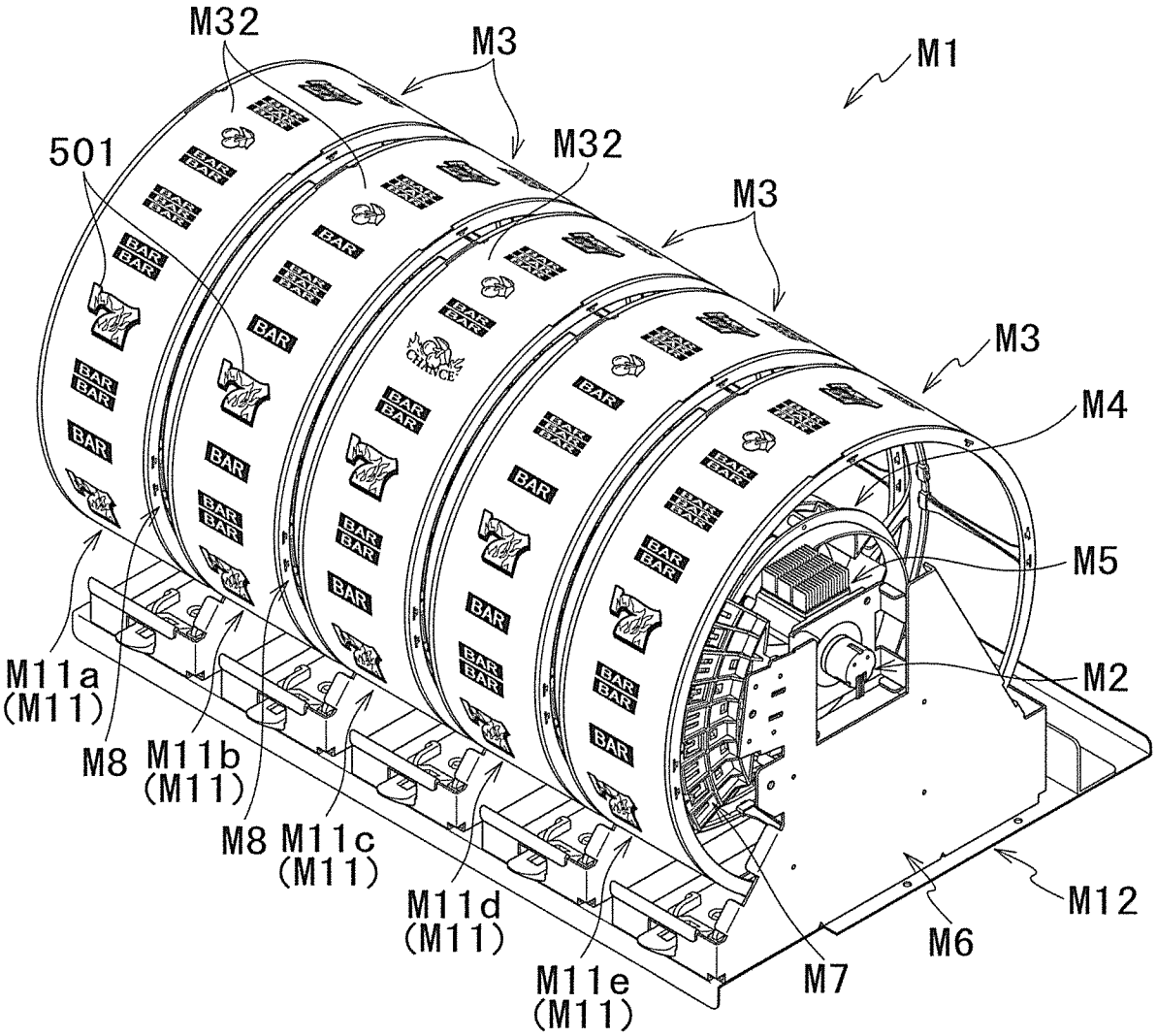
FIG. 10 is a perspective view of the reel device.

The reel device M1 provided to the slot machine 10 has the reels M3 which are supported so that the reels M3 are horizontally aligned and are concentric with each other as shown in FIG. 10. That is, the reel device M1 has reel assemblies M11 each of which rearranges symbols 501 by rotating the reel M3 on which symbols 501 are aligned on the outer circumferential surface thereof, and a reel assembly holding mechanism M12 configured to detachably hold the reel assemblies M11 (i.e., reel assemblies M11*a*, M11*b*, M11*c*, M11*d*, and M11*e*). In the following description, the reel assemblies M11 are referred to as a first reel assembly M11*a* to a fifth reel assembly M11*e*, from the left to right viewed from the front side, when the location of the reel assemblies needs to be specified.

(Reel Assembly M11)

Each reel assembly M11 includes the reel M3 having symbols 501 aligned on its outer circumferential surface, and a reel support mechanism M6 supporting the reel M3. The reel M3 has the annular reel band M32 on which one or more symbols 501 are aligned.

(Reel Assembly M11: Reel Band M32)

Figure 11:
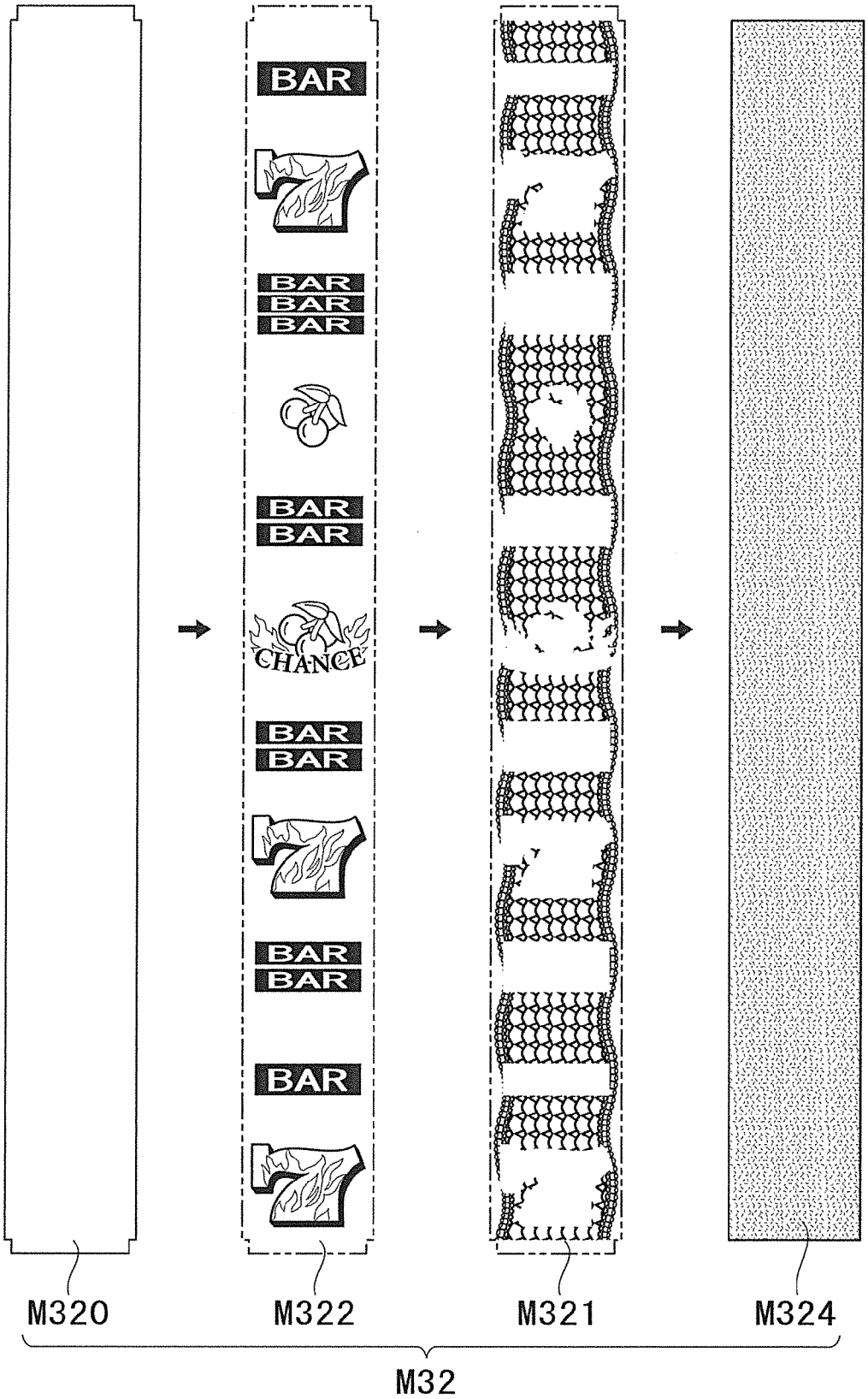
FIG. 11 is an explanatory diagram showing layers of the reel band.
Figure 12:
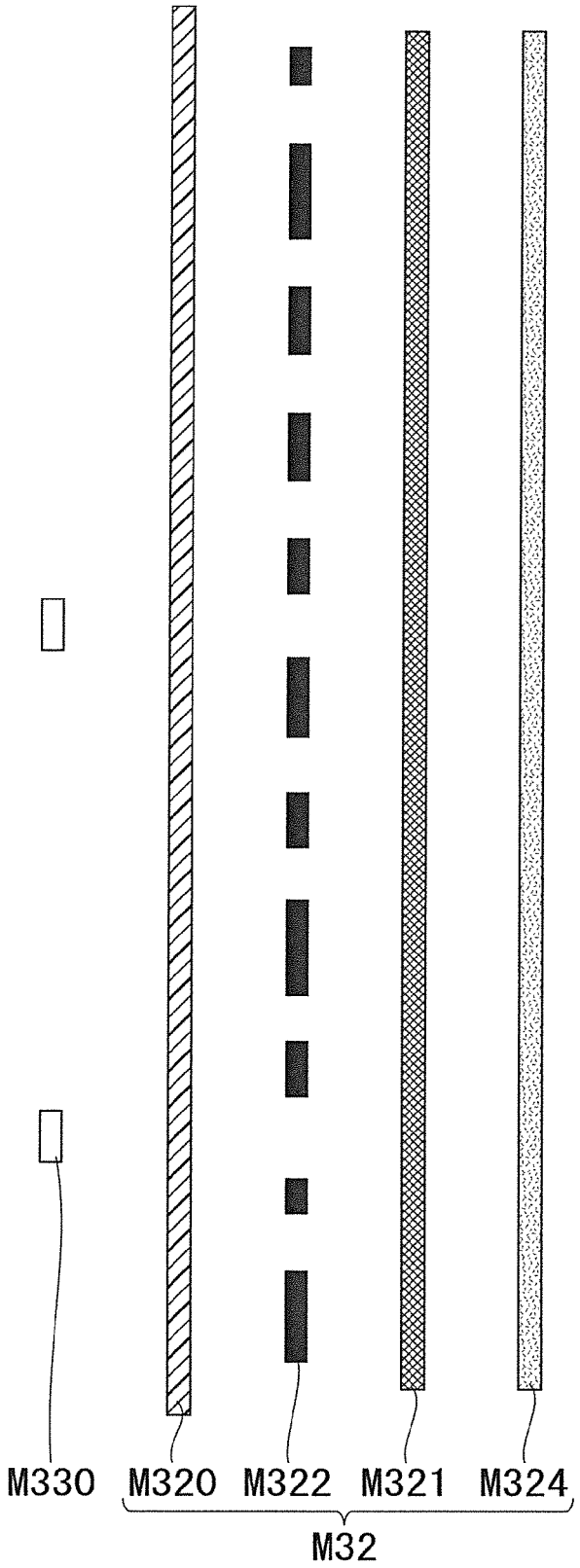
FIG. 12 is an explanatory diagram showing the layers of the reel band.
Figure 13:
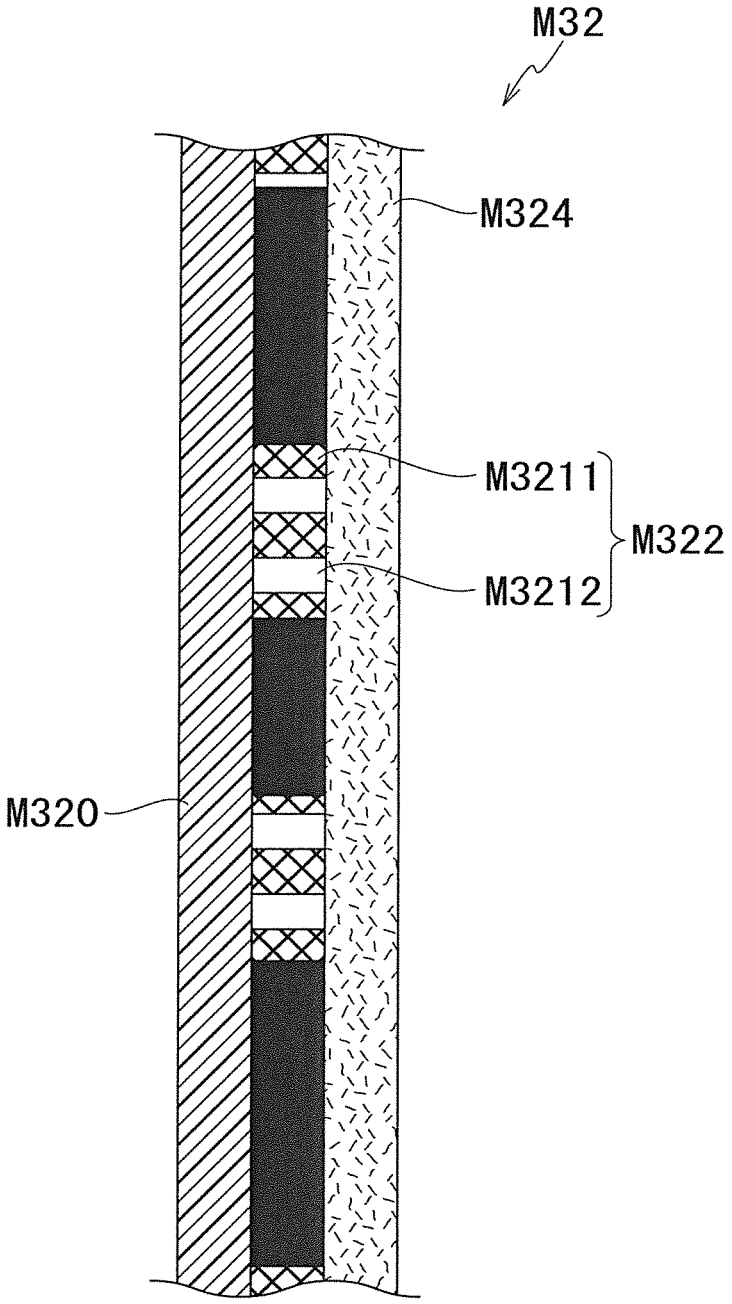
FIG. 13 is a schematic partial sectional view of the reel band.

As shown in FIGS. 11 to 13, the reel band M32 has the base layer M320, the symbol print layer M322, and the mesh pattern layer M321. In the present embodiment, the reel band M32 has a dispersion layer M324 as an outermost layer; however, the present invention is not limited to this. That is, the dispersion layer M324 does not have to be provided. The base layer M320 functions as a supporter of the reel band M32. The base layer M320 is translucent since the light emitted from the backlight unit M7 has to be transmitted through the base layer M320. Further, the base layer M320 is preferably made of a hard resin resistant to bending since the base layer M320 is bended into the shape of a reel. In the present embodiment, the base layer M320 is made of polyethylene terephthalate (PET). The symbol print layer M322 is formed by printing symbols on the base layer M320 using plastic paint. Areas where the symbols are printed are the symbol-formed areas M3210.

The mesh pattern layer M321 is laminated on an area different from the symbol-formed areas M3210. That is, the mesh pattern layer M321 is laminated on the base layer M320 so that the mesh pattern layer M321 covers the area other than the symbol-formed areas M3210 where the symbol print layer M322 is formed. As described above, the mesh pattern layer M321 includes the shield areas M3211 and the non-laminated areas M3212. The mesh pattern layer M321 is formed by printing a pattern of the shield areas M3211 using plastic paint. Thus, the areas having no printing are the non-laminated areas M3212. As shown in FIG. 13, the symbol print layer M322 and the shield areas M3211 of the mesh pattern layer M321 are laminated on the base layer M320. Note that, the present invention is not limited thereto, and the mesh pattern layer M321 may be laminated on the opposite surface of the base layer M320 from the symbol print layer M322.

The dispersion layer M324 is a light dispersing sheet formed by a flexible polyvinyl chloride (PVC).

The dispersion layer M324 is arranged so as to be positioned on the side of the front surface of the cabinet 11 which is on the side of the player. That is, the dispersion layer M324 is arranged on the outermost circumferential surface of the reel M3. On the side of the inner circumference surface (back surface side) of the dispersion layer M324, the mesh pattern layer M321, the symbol print layer M322, and the base layer M320 are arranged in this order. Note that a transparent protection layer may be provided on the front surface side of the dispersion layer M324.

Figure 14:
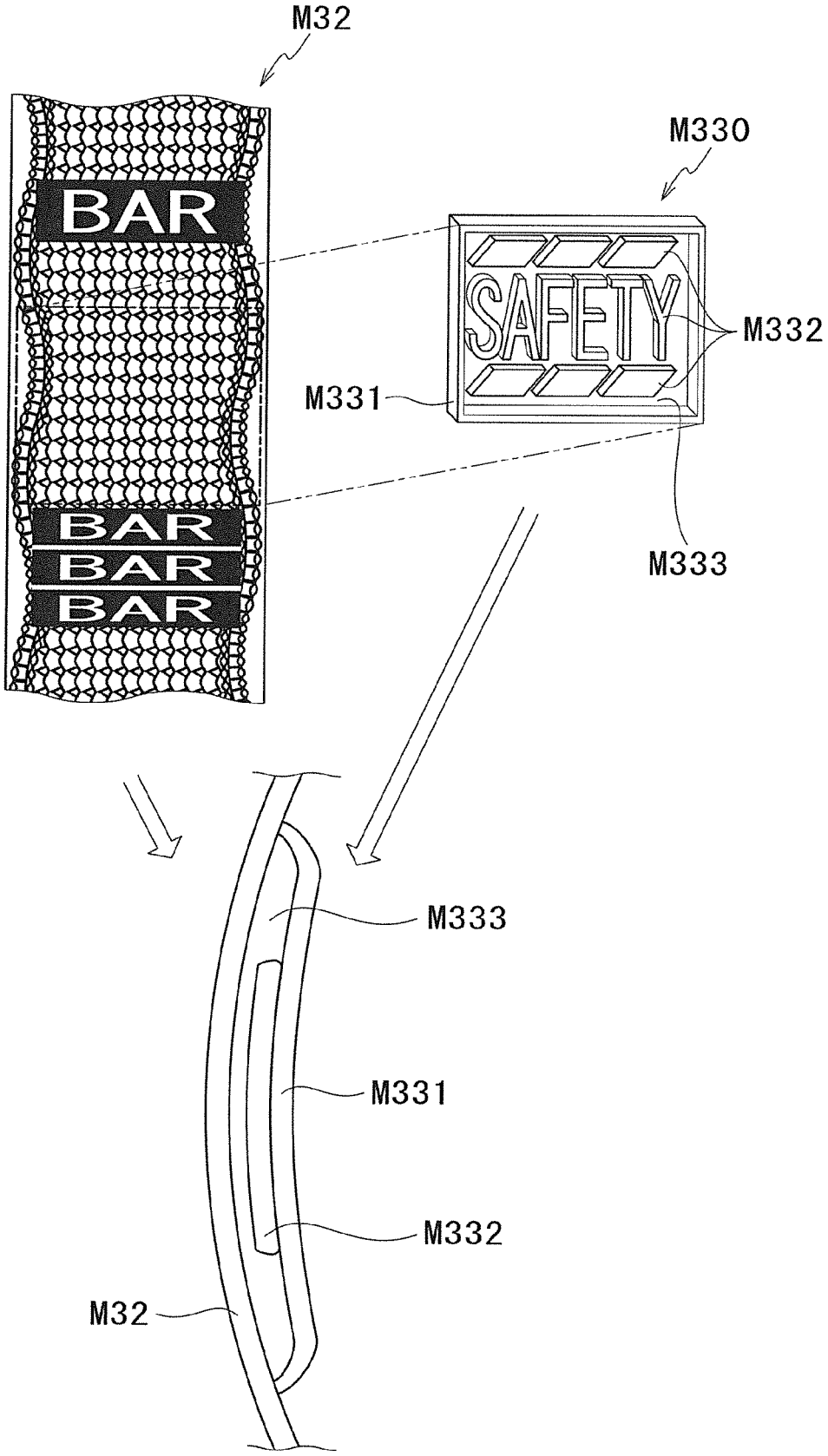
FIG. 14 is an explanatory diagram showing a three dimensional recessed part on the reel band.

As shown in FIG. 14, the three dimensional recessed part M330 is provided on the innermost layer of the reel band M32. That is, the three dimensional recessed part M330 is disposed in the reel band M32 at an inner position relative to the base layer M320. The three dimensional recessed part M330 has the recessed member M331 and the show-through symbol M332. The recessed member M331 is a box-like member having an opening, and has a recessed shape in cross-section. The recessed member M331 is attached to the reel band M32 (to the base layer M320) so that a portion of the recessed member M331 defining the above opening contacts the base layer M320. Thus, the recessed member M331 and the reel band M32 create an internal space M333. The recessed member M331 is translucent, and passes therethrough the illuminating light emitted from the backlight unit M7.

The show-through symbol M332 is three-dimensionally formed on the inner wall surface of the recessed member M331. That is, the show-through symbol M332 is provided in the internal space M333 created by the recessed member M331 and the reel band M32. In the present embodiment, the show-through symbol M332 is translucent; however, the present invention is not limited thereto. The show-through symbol M332 does not have to be translucent. Further, in the present embodiment, the show-through symbol M332 is colored green; however, the present invention is not limited thereto. The show-through symbol M332 may be colored red, pink, or any other color. The show-through symbol M332 does not have to be colored.

Furthermore, in the present embodiment, the innermost layer is the base layer M320. However, in the case where the mesh pattern layer M321 is laminated on the opposite side of the base layer M320 from the symbol print layer M322, the innermost layer on which the three dimensional recessed part M330 is provided is the mesh pattern layer M321.

(Reel Assembly M11: Backlight Unit M7)

As shown in FIG. 10, the backlight unit M7 is provided on the inner circumference side of each reel M3 having the structure described above. The backlight unit M7 is configured to emit illumination light (inner illuminating light) from the inner circumference side of the reel M3 towards the reel band M32. The illumination light having passed the reel band M32 is visible from the outside of the slot machine 10. Thus, it appears to the player as if the symbols 501 are displayed on the reel band M32.

The backlight unit M7 includes a plurality of full color LEDs which are not illustrated. Each full color LED R121 is a light source including light emitting diode chips of the three primary colors, i.e., red, green, and blue. The full color LED R121 is capable of creating illuminating light of any given color by adjusting the amount of light of each light emitting diode. This way, the backlight unit M7 is capable of emitting illuminating light of any given color from the inner circumference side of the reel M3 toward the reel M3.

(Reel Assembly M11: Effect Light Emitter M8)

Further, on the side of each reel M3 is arranged an effect light emitter M8 (see FIG. 10). The effect light emitter M8 is configured to emit a plurality of types of effect light so as to be seen from the outside of the slot machine 10. Thus, the effect light emitter M8 improves the freedom of the effect and the effect itself, when the reels M3 are rotated, or when the symbols 501 are rearranged.

(Light Application Device R1)

As shown in FIGS. 4 to 10, the light application device R1 configured to emit illuminating light (outer illuminating light) to the reels M3 of the reel device M1 is disposed on the outer circumference side of the reel device M1. The light application device R1 has two parts which are respectively disposed above and below the reel device M1 having the reels M3. Thus, the light application device R1 is disposed in a position out of a sight area in which the reels M3 are visible from the outside of the cabinet 11 through the display window 150. The light application device R1 enables an effect on the display window 150, as is the effect on the display window 150 using the transparent liquid crystal panel or a half mirror disposed in front of the reels M3, by using reflection of illuminating light applied to each reel M3. This way, the light application device R1 enables an effect on the display window 150, without a need of a space for arranging a transparent liquid crystal panel or the like in front of the reels M3.

Note that the light application device R1 may be disposed in at least one of the positions above and below the reel device M1. Specifically, the light application device R1 may be disposed in the outside area in at least one of the positions above or below the display window 150, and may be configured to emit outer illuminating light which is wider than the entire width of all the reels M3 of the reel device M1.

Further, the light application device R1 is provided to the reel cover 134 which serves as a front wall for the display window 150. The light application device R1 and the reel cover 134 are formed into a unit. This way, the light application device R1 is attached at the same time the reel cover 134 is attached to the cabinet 11.

Note that the light application device R1 is set so as to apply outer illuminating light to the surface of the reel device M1. In other words, the light application device R1 is set so as to apply outer illuminating light to a non-active range area, i.e., an area other than the area of the active range of the symbols 501.

Specifically, the light application device R1 includes the translucent panel R11 (translucent member) provided to the opening 1343*a* of the panel supporter 1343, and the light source R12 configured to emit outer illuminating light. The translucent panel R11 is structured so that the light source R12 and the outer illuminating light emitted from the light source R12 do not directly enter the eyes of the player. The translucent panel R11 has substantially the same width as that of the reel device M1. Further, the light source R12 is configured to emit the outer illuminating light across the entire width of the translucent panel R11.

The light source R12 has a plurality of full color LEDs R121. Each full color LED R121 is a light source including light emitting diode chips of the three primary colors, i.e., red, green, and blue. The full color LED R121 is capable of creating illuminating light of any given color by adjusting the amount of light of each light emitting diode. The full color LEDs R121 are arranged in a matrix in the directions of width and depth. Specifically, as shown in FIG. 4, the light source R12 includes LED units R123 disposed so as to correspond the reels M3. Each LED unit R123 is constituted by two sets of four full color LEDs R121 arranged in two rows and two columns, the two sets being aligned in the direction parallel to the width of the reel band M32. Therefore, the position of the reel device M1 where the light is applied is adjustable by selecting the full color LED to be turned on.

(Display on the Display Window 150)

The following describes display on the display window 150 by means of the reel bands M32 having the above-described structure.

(Display on Reel Bands M32)

Figure 15:
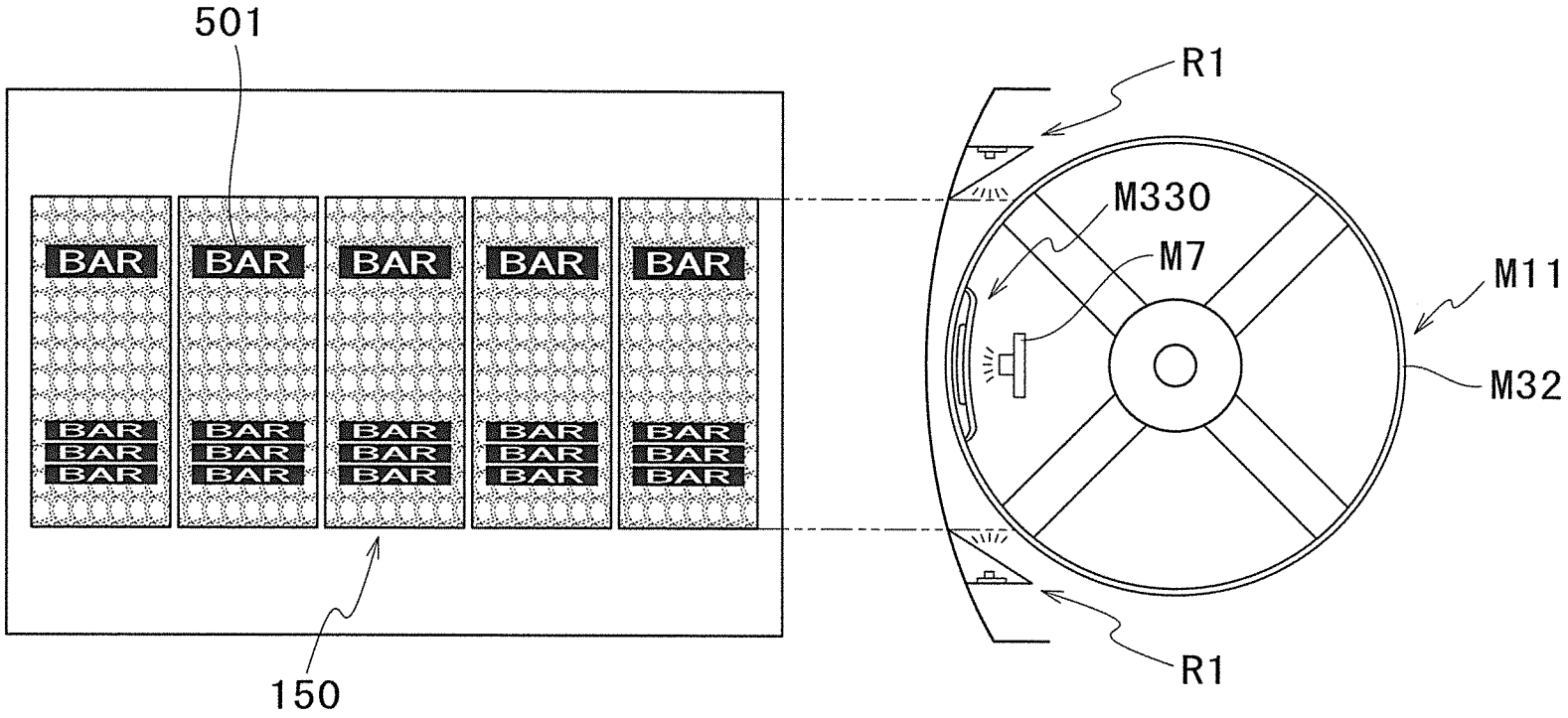
FIG. 15 is an explanatory diagram showing display on the reel bands.

As shown in FIG. 15, each reel band M32 is illuminated by illuminating light emitted from the backlight unit M7 and the light application device R1. The illuminating light to the reel band M32 from the backlight unit M7 and the light application device R1 is adjusted depending on the area ratio of the shield areas M3211 to the non-laminated areas M3212 on the mesh pattern layer M321. That is, a part of the illuminating light emitted from the backlight unit M7 toward the player is blocked by the shield areas M3211, to prevent all the inner illuminating light from directly going to the player. Meanwhile, a part of the illuminating light emitted from the light application device R1 to the reel bands M32 passes through the non-laminated areas M3212, to prevent all the outer illuminating light from being directly reflected toward the player. This way, in the area where the symbols 501 are not formed, the transmittance of the illuminating light is adjusted by depending on the area ratio of the shield areas M3211 to the non-laminated areas M3212, without using the conventional sheet for decreasing the transmittance.

In addition, the pattern for the rough texture provided by the mesh pattern layer M321 emerges on the reel band M32. That is, the illuminating light emitted from the light application device R1 and/or from the backlight unit M7 does not pass through the shield areas M3211 of the mesh pattern layer M321 (or a part of the illuminating light is blocked by the shield areas M3211), but passes through the non-laminated areas M3212, and thereby a shaded pattern of the rough texture emerges. Thus, the reel bands M32 are decorated without using conventional decoration made by printing images. Since the shield areas M3211 are three-dimensionally laminated on the base layer M320, the rough texture is provided to the reel band M32 even without the illuminating light.

(Display on Reel Bands M32: Three Dimensional Recessed Part M330)

The following describes display on the display window 150, particularly for the parts where the three dimensional recessed parts M330 are provided.

Figure 16:
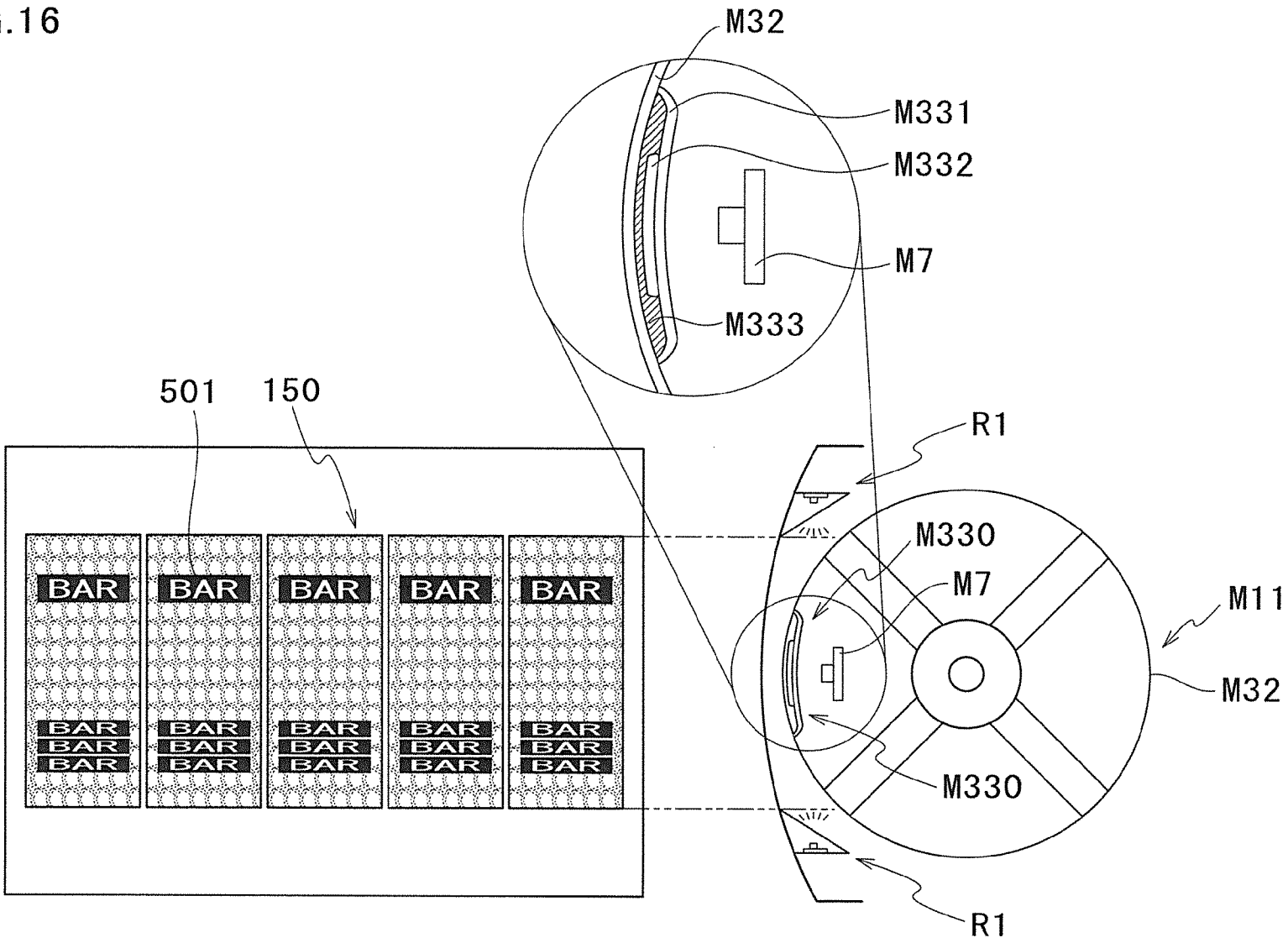
FIG. 16 is an explanatory diagram showing a display window in a show-through symbol non-display state.

As shown in FIG. 16, in the case where the light application device R1 is turned on and the backlight units M7 are turned off, the inside of the internal space M333 created by each reel band M32 and the corresponding recessed member M331 is darker than the outside of the reel band M32. That is, a part of the outer illuminating light emitted from the light application device R1 is blocked by the mesh pattern layer M321 of the reel band M32, and therefore, it is impossible or difficult to see, through the reel band M32, the show-through symbol M332 provided in the internal space M333 (hereinafter, this state is referred to as a show-through symbol non-display state).

Figure 17:
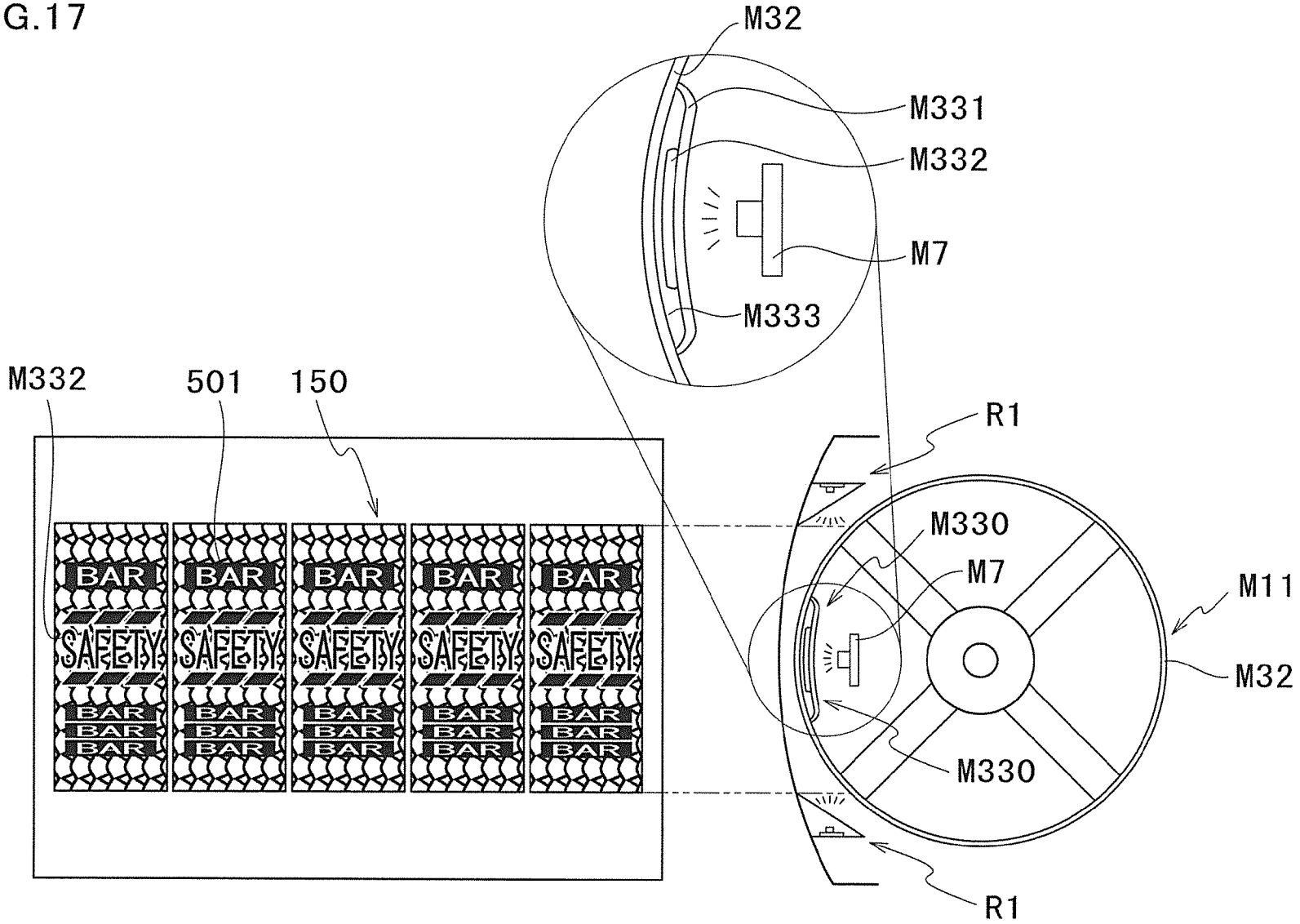
FIG. 17 is an explanatory diagram showing the display window in a show-through symbol display state.

As shown in FIG. 17, in the case where both of the light application device R1 and the backlight units M7 are turned on, the inside of the internal space M333 created by each reel band M32 and the corresponding recessed member M331 is lighter than the outside. That is, it is easier to see, through the reel band M32, the show-through symbol M332 provided in the internal space M333 than in the show-through symbol non-display state (hereinafter, this state is referred to as a show-through symbol display state). Accordingly, the show-through symbols M332 are visible on the display window 150.

Thus, in the case where each backlight unit M7 is turned off, the internal space M333 of the recessed member M331 is illuminated by the light emitted from the illumination or the like provided outside of the reel device M1 and passing through the mesh pattern layer M321, the transmittance of which light is adjusted depending on the area ratio of the shield areas M3211 to the non-laminated areas M3212 on the mesh pattern layer M321. Therefore, the inside of the internal space M333 of the recessed member M331 is darker than the outside of the reel device M1. This makes it impossible or difficult to see, from the outside, the show-through symbol M332 provided in the internal space M333. In the case where each backlight unit M7 is turned on, the internal space M333 of the recessed member M331 is illuminated by the backlight unit M7, and this makes it possible to see the show-through symbol M332 from the outside. Accordingly, it is possible to mount a symbol of which display and non-display on the reel is switchable, even if the reel is a mechanical reel.

As described above, in the present embodiment, each show-through symbol M332 is translucent and colored. Therefore, the state in which the show-through symbols M332 are not displayed (are not visible or difficult to be seen) on the display window 150 may be created by applying from the backlight units M7 the illuminating light having the same color or the same type color as that of the show-through symbols M332. Alternatively, the state in which the show-through symbols M332 are not displayed (are not visible or is difficult to be seen) may be created by increasing the intensity of the outer illuminating light emitted from the light application device R1 so as to be greater than the inner illuminating light from the backlight units M7, so that the inside of the internal space M333 is relatively darker. Thus, the show-through symbol non-display state is not limited as long as it is more difficult to see the show-through symbols M332 in the internal spaces M333 than in the show-through symbol display state.

In the case where the illuminating light emitted from the backlight units M7 has a complementary color of the color of the show-through symbol M332, the visibility of the show-through symbols M332 is improved.

(Electrical Configuration of Slot Machine)

Figure 18:
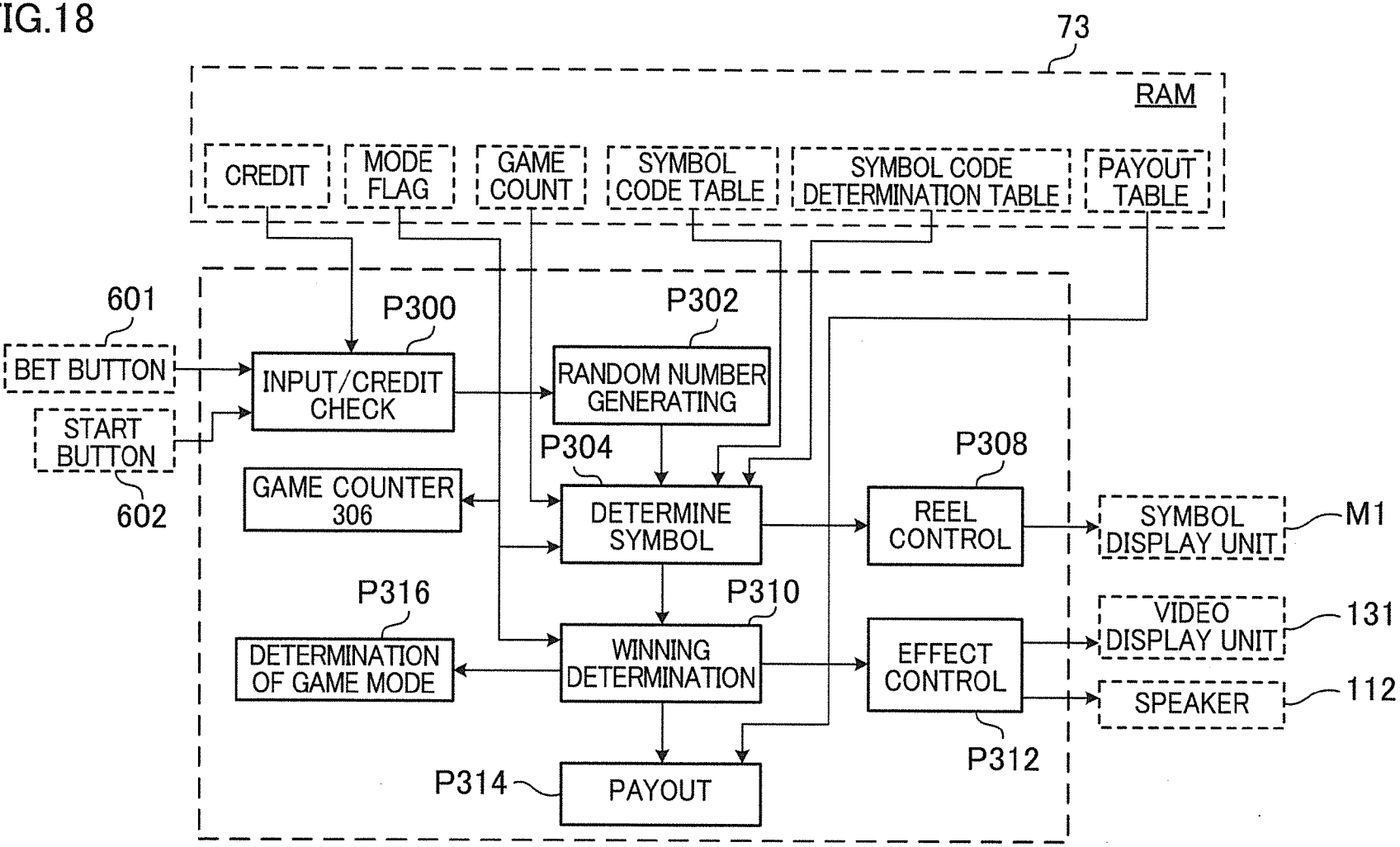
FIG. 18 is an electric block diagram of a slot machine.

Now, referring to FIG. 18, the configuration of a circuit in the slot machine 10 will be described.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a non-volatile memory, and stores a game program and a game system program. The game program includes a program related to game progression and a program for producing effects by images and sounds. The game program further includes a symbol determination program. The symbol determination program is a program for determining symbols 501 to be rearranged.

The game program further includes sets of data such as: normal game symbol table data indicating a normal game symbol table that shows the relationship of each symbol in each symbol array of the display block, a code number, and a random number; bonus game symbol table data indicating a bonus game symbol table that shows the relationship of each symbol of each symbol array of the display block, a code number, and a random number; symbol number determination table data indicating a symbol column determination table; code number determination table data indicating a code number determination table; wild symbol increase amount determination table data indicating a wild symbol increase amount determination table; trigger symbol increase number determination table data indicating a trigger symbol increase number determination table; odds data indicating the relationship between the types and the number of rearranged symbols on a payline L and a payout amount.

Further, the card slot 55 is configured so that the memory card 54 can be inserted thereinto and removed therefrom, and is connected to a motherboard 70 by an IDE bus. The type and contents of the game to be played on the slot machine 10 can be changed by drawing out the memory card 54 from the card slot 53S, writing another game program into the memory card 54, and inserting the memory card 54 into the card slot 53S.

The GAL 56 is a type of PLD (Programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents of the game to be played on the slot machine 10 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like.

The authentication program is a program (falsification check program) for authenticating the game program and the game system program. The pre-authentication program is a program for authenticating the aforementioned authentication program. The authentication program and the pre-authentication program are written along a procedure (authentication procedure) for proving that the program to be the subject has not been falsified.

The motherboard 70 is constituted by a commercial general-purpose mother board (printed writing board on which basic components for personal computers are mounted) and is provided with a main CPU 71, a ROM (Read Only Memory) 72, a RAM (Random Access Memory) 73, and a communication interface 82. This motherboard 70 is equivalent to the game controller 100 of the present embodiment.

The ROM 72 includes a memory device such as a flash memory, and stores a program such as BIOS (Basic Input/Output System) to be executed by the main CPU 71, and permanent data. When the BIOS is executed by the main CPU 71, processing for initializing predetermined peripheral devices is conducted. Further, through the gaming board 50, processing of loading the game program and the game system program stored in the memory card 54 is started. In the present invention, the ROM 72 may be or may not be rewritable.

The RAM 73 stores data used for the operation of the main CPU 71 and programs such as the symbol determination program. For example, when the processing of loading the aforementioned game program, game system program or authentication program is conducted, the RAM 73 can store the program. The RAM 73 is provided with working areas used for operations in execution of these programs. Examples of the areas include: an area that stores the number of games, the number of bets, the number of payouts, the number of credits and the like; and an area that stores symbols (code numbers) randomly determined.

The communication interface 82 is for communicating with an external controller 621 such as a server, through the communication line 301. Further, the motherboard 70 is connected with a later-described door PCB (Printed Circuit Board) 90 and a body PCB 110 by respective USBs. The motherboard 70 is also connected with a power supply unit 81. Furthermore, the motherboard 70 is connected with the PTS terminal 700 by an USB.

When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the body PCB 110 are connected with input devices such as a switch and a sensor, and peripheral devices the operations of which are controlled by the main CPU 71.

The door PCB 90 is connected with the control panel 30, a reverter 91, a coin counter 92C and a cold cathode tube 93.

The control panel 30 is provided with a reserve switch 31S, a collect switch 32S, a game rule switch 33S, a 1-BET switch 34S, a 2-BET switch 35S, a 3-BET switch 37S, a 5-BET switch 38S, a 10-BET switch 39S, a play-2-lines switch 40S, a play-10-lines switch 41S, a play-20-lines switch 42S, a play-40-lines switch 43S, a MAX LINE switch 44S, a gamble switch 45S, and a start switch 46S, which correspond to the above-described buttons. Each of the switches outputs a signal to the main CPU 71 upon detection of press of the button corresponding thereto by the player.

Inside the coin entry 21 are provided the reverter 91 and the coin counter 92C. The reverter 91 validates a coin inserted into the coin entry 21, and discharges coins other than genuine coins through a coin payout exit. The coin counter 92C detects the received genuine coins and counts the number of the coins.

The reverter 91 operates based on a control signal output from the main CPU 71, and distributes valid coins validated by the coin counter 92C into a hopper 113 or a cash box (not shown). That is, coins are distributed into the hopper 113 when the hopper 113 is not filled with coins, while coins are distributed into the cash box when the hopper 113 is filled with coins.

The cold cathode tube 93 functions as a backlight installed on the back side of the upper image display panel 131, and is turned on based on a control signal output from the main CPU 71.

The body PCB 110 is connected with the reel device M1 including the plurality of reel assemblies M11*a*, M11*b*, M11*c*, M11*d*, and M11*e*, the light application device R1, the lamp 111, the speakers 112, the hopper 113, a coin detecting portion 113S, the bill entry 22, a graphic board 130, a key switch 173S, and the data displayer 174.

The lamp 111 turns on based on a control signal output from the main CPU 71. The speakers 112 output BGM sound or the like based on a control signal output from the main CPU 71.

The hopper 113 operates based on a control signal output from the main CPU 71, and pays out coins of the specified number of payouts from the coin payout exit to an unillustrated coin tray. The coin detecting portion 113S outputs a signal to the main CPU 71 upon detection of coins paid out by the hopper 113.

The bill entry 22 authenticates the bills and receives genuine bills into the cabinet 11. The bills received by the cabinet 11 are converted onto the number of coins, and the credits equivalent to the converted coins are added as the credits owned by the player.

The graphic board 130 controls display of images conducted by the upper image display panel 131, based on a control signal output from the main CPU 71. The graphic board 130 is provided with a VDP (Video Display Processor) generating image data, a video RAM temporarily storing the image data generated by the VDP, and the like. It is to be noted that the image data used in generation of image data by the VDP is included in the game program that has been read from the memory card 54 and stored into the RAM 73.

The key switch 173S is provided in the keypad 173, and outputs a predetermined signal to the main CPU 71 when the keypad 173 is operated by the player.

The data displayer 174 displays data read by the card reader 172 and data inputted by the player through the keypad 173, based on a control signal outputted from the main CPU 71.

(Processes of Game Program)

Figure 19:
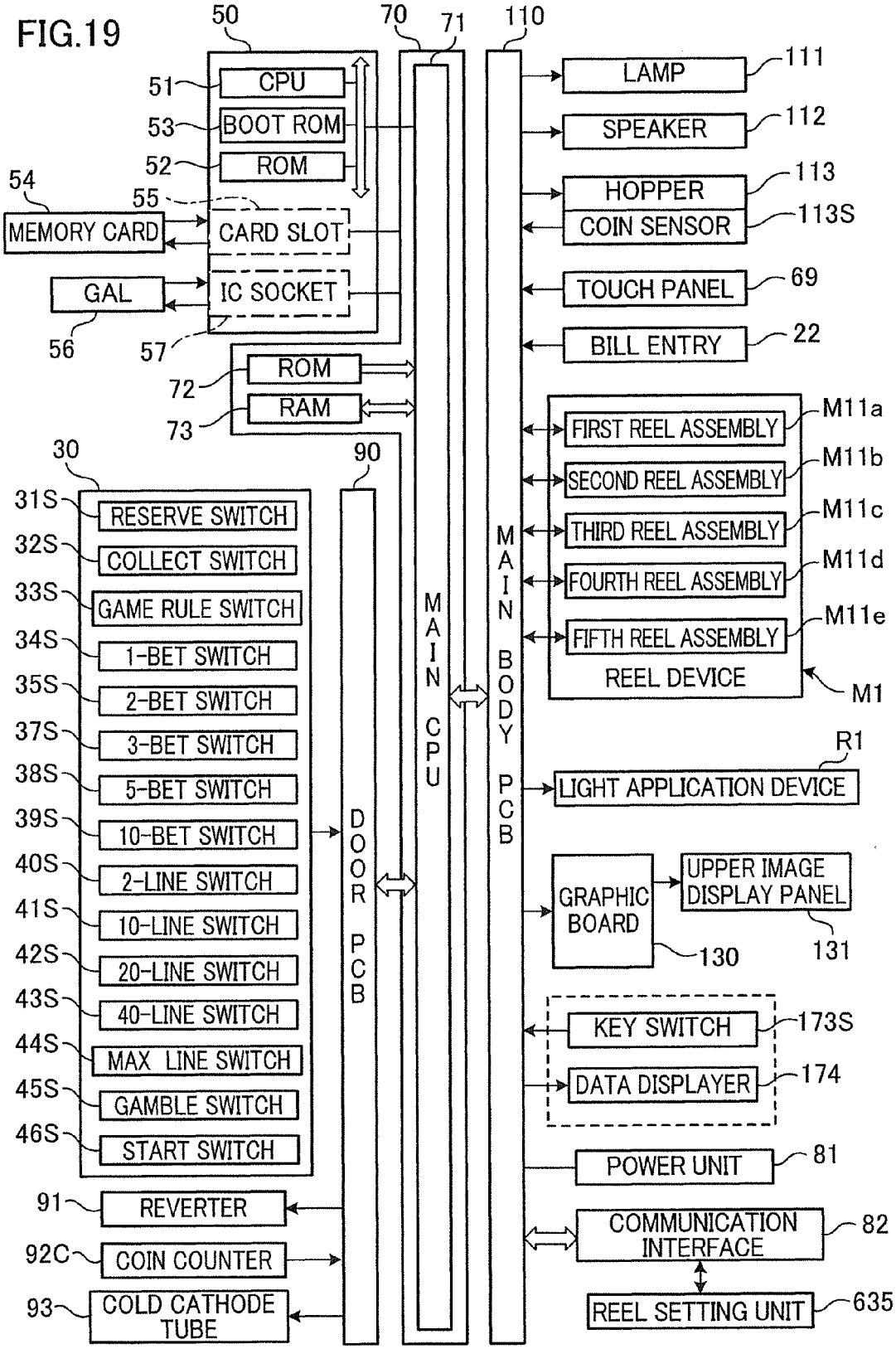
FIG. 19 is a block diagram showing a process of a main game program run by a motherboard.

FIG. 19 is a block diagram showing a process of a game program run by the main CPU 71 of the motherboard 70. When the power is supplied to the slot machine 10, the main CPU 71 loads authenticated game program and authenticated game system program from the memory card 54 via the gaming board 50 and Wright them into RAM 73. Through this, the game program is loaded into the RAM 73 and run.

In a preferable embodiment, the game program includes: an input/bet checking process P300, a random number generating process P302, a symbol determination process P304, a game counter, a reel control process P308, a winning determination process P310, an effect generating control process P312, a payout process P314, and a game mode determination process P316.

(Input/Bet Checking Process P300)

In the input/bet checking process P300, whether a "BET" button or a "START" button is pressed is continuously checked, during the idle state in which the reels M3 of the first to fifth reel assemblies M11*a* to M11*e* are stopped. If the "BET" button 601 or the spin button 602 (start button) is pressed, whether there is any remaining player credit is checked based on the credit data 320 stored in the RAM 73, in the input/bet checking process P300. If there is at least one player credit, the random number generating process P302 is called from the input/bet checking process P300.

Then, in the random number generating process P302, a random number is generated for use in the symbol determination process P304. In the present embodiment, five random numbers are generated in the random number generating process P302. The five random numbers are used for the reels M3 of the first to fifth reel assemblies M11*a* to M11*e*, respectively.

After all the five random numbers are extracted, symbols to be stopped are determined for each reel M3, referring to the symbol code determination table stored in the RAM 73, in the symbol determination process P304. In the symbol determination process P304, the five random numbers are used to determine symbols to be stopped for the five reels M3, and the symbols to be stopped are displayed on the reels M3 of the first to fifth reel assemblies M11*a* to M11*e* of the reel device M1, through the display window 150.

In particular, in the symbol determination process P304, the current game mode is checked by referring to the mode flag 322 stored in the RAM 73. The process of determining the symbols is different between the normal mode and the chance mode. In the normal mode, the symbols are determined by using random numbers and a constant symbol code determination table, through a constant procedure, in the symbol determination process P304. In the chance mode on the other hand, the symbol determination process is changed by continuously changing the symbol code determination table for each of the unit games, in the symbol determination process P304. Continuously changing the symbol code determination table enables an increase in the probability of winning combination including at least one specific symbol, as the chance mode game continues. The number of chance mode games in a single session is limited to a predetermined number of times; e.g., eight times. To limit the number of chance mode games, the game counter 306 counts the number of chance mode games already played and/or the number of chance mode games remaining in the session. The value of game count is stored in the RAM 73. The game counter may belong to the symbol determination process P304.

In the reel control process P308, stop position information according to the symbols determined is supplied to control the reel device M1. This way, the reels M3 of the first to fifth reel assemblies M11*a* to M11*e*, after the rotation, stop in positions designated by the stop position information. In other words, the symbols scroll with the rotation of the reels M3. Next, the reels M3 are stopped so that the symbols determined are rearranged in the middle position of the reel device M1 in the display window 150, with respect to the vertical direction.

The winning determination process P310 determines whether or not the predetermined winning combination is formed by the rearranged symbols. When the winning combination is formed by the rearranged symbols, the reel device M1 and another device are controlled in the effect generating control process P312. The other device may be the speakers 112, the lamp, the upper image display panel 131, or the like. Examples of an effect include one by video and audio, and one by a change in the backlight and illumination. Further, in the payout process P314, the amount of payout is determined according to the winning combination, and that amount of payout is awarded to the player.

Further, every time the unit game ends, the game mode of the subsequent unit game is determined in the game mode determination process P316. When the rearranged symbols cause a trigger event, there will be shifting from the normal mode to the chance mode in the game mode determination process P316. On the other hand, when the end condition is satisfied, there will be shifting from the chance mode to the normal mode in the game mode determination process P316. In other occasions, the game mode is maintained in the game mode determination process P316. The game mode determination process P316 may be executed in the winning determination process P310.

(Symbol, Winning Combination, and Payline)

FIG. 20 shows an exemplary symbol code table defining the symbols to be placed on the outer circumference surfaces of the reels M3 of the first to fifth reel assemblies M11*a* to M11*e*.

With the symbols on each reel M3, symbol arrays each including 11 symbols are formed. As described later, the alignments of symbols on the reels M3 are hereinafter referred to as first to fifth symbol arrays. In the present embodiment, each symbol array includes six types of symbols. The six types of symbols include: "7", "BAR", "Two BARs", "Three BARs", "Cherry", and "Chance Cherry". In each symbol array, codes "00" to "10" are allotted to the symbols, respectively. For example, the first symbol "BAR" in the first symbol array is given the code "00". The second symbol "7" in the first symbol array is given the code "01". The eighth symbol "7" in the first symbol array is given the code "07".

Three successive symbols out of each symbol array are shown on the display window 150 of the reel device M1. This forms a symbol matrix of 3 rows and 5 columns on the display window 150. Every time the "BET" button or the "START" button is pressed, the reels M3 with symbols start rotating, and shows the symbols 501 on the display window 150 in such a manner that the symbols 501 scrolls vertically on the display window 150. After a predetermined period have passed, the scroll of symbols 501 is stopped, and the symbols are rearranged to form the symbol matrix on the display window 150.

<"Chance Cherry" Symbol>

Figure 21:
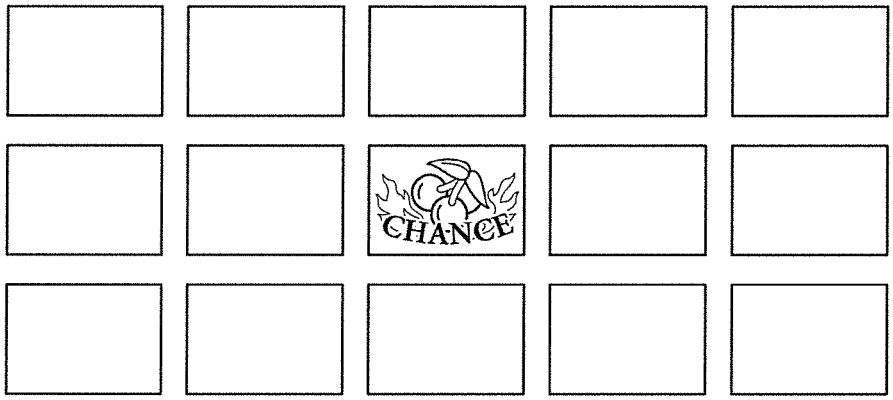
FIG. 21 is a diagram showing a state in which a trigger symbol is arranged in a predetermined position of a symbol matrix, and shows a trigger condition for shifting to a chance mode.

The "Chance Cherry" symbol appearing only on the third symbol array functions as a trigger symbol that shifts the game mode to the chance mode. In the present embodiment, the "Chance Cherry" symbol has a shape that resembles to the "Cherry" symbol; however, there is an image of a flame surrounding the cherry at the background, which is integrated into the image of cherry. The chance mode starts when the "Chance Cherry" symbol appears at the second position in the third column on the display window 150, as the result of rearrangement, as shown in FIG. 21. The condition for having the game mode return to the normal mode is described later.

There are a plurality of predetermined combinations of symbols that award a benefit to the player (hereinafter, referred to as a "winning combination"). The benefit to be awarded to the player includes a predetermined amount of payout in the form of an increase in the credit, or returning coins.

Figure 22:
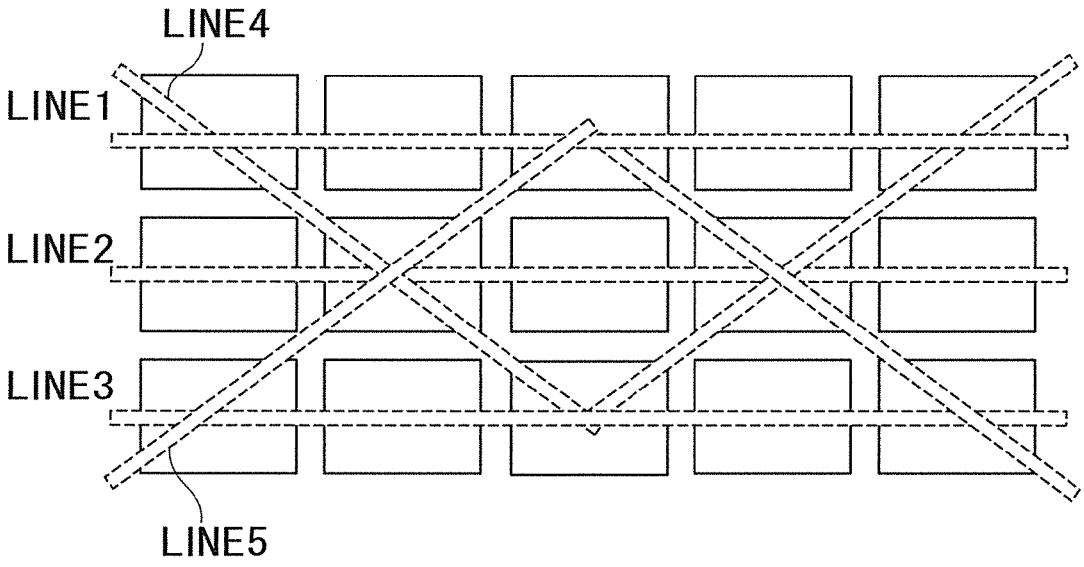
FIG. 22 is a diagram showing paylines of the gaming machine related to an embodiment.

FIG. 22 indicates paylines determined in a preferable embodiment of the present invention. In the present embodiment, there are 5 paylines for the symbol matrix. The first to third paylines each extend in a horizontal direction, respectively through the first to third rows of the symbol stop positions in the symbol matrix. The fourth payline forms a "V" shape, and extends through the symbol stop positions of: the first row, the first column; the second row, the second column; the third row, the third column; the second row, fourth column; and the first row, fifth column. The fifth payline forms a counter "V" shape, and extends through the symbol stop positions of: the third row, the first column; the second row, the second column; the first row, the third column; the second row, the fourth column; and the third row, and the fifth column.

The paylines are each individually activated according to the player selection. Activating all the five paylines however is done, irrespective of the bet amount or the player selection. The total number of paylines is modifiable according to the size of the symbol matrix, and an additional payline may be set as needed.

(Game Mode (Normal Mode and Chance Mode))

The slot machine 10 has two modes (the normal mode and the chance mode) which are selectively switched from one to another. The processes of games in the chance mode are mostly the same as those of the normal mode. However, the payouts for at least some of the winning combinations in the chance mode are different from those of the normal mode. Further, the effects such as the video effect and the sound effect may be differentiated between the two game modes. Note that, in the present specification, the unit game run in the normal mode is sometimes simply referred to as normal mode game. Similarly, the unit game run in the chance mode is sometimes simply referred to as chance mode game.

(Shifting of Game State)

Figure 23:
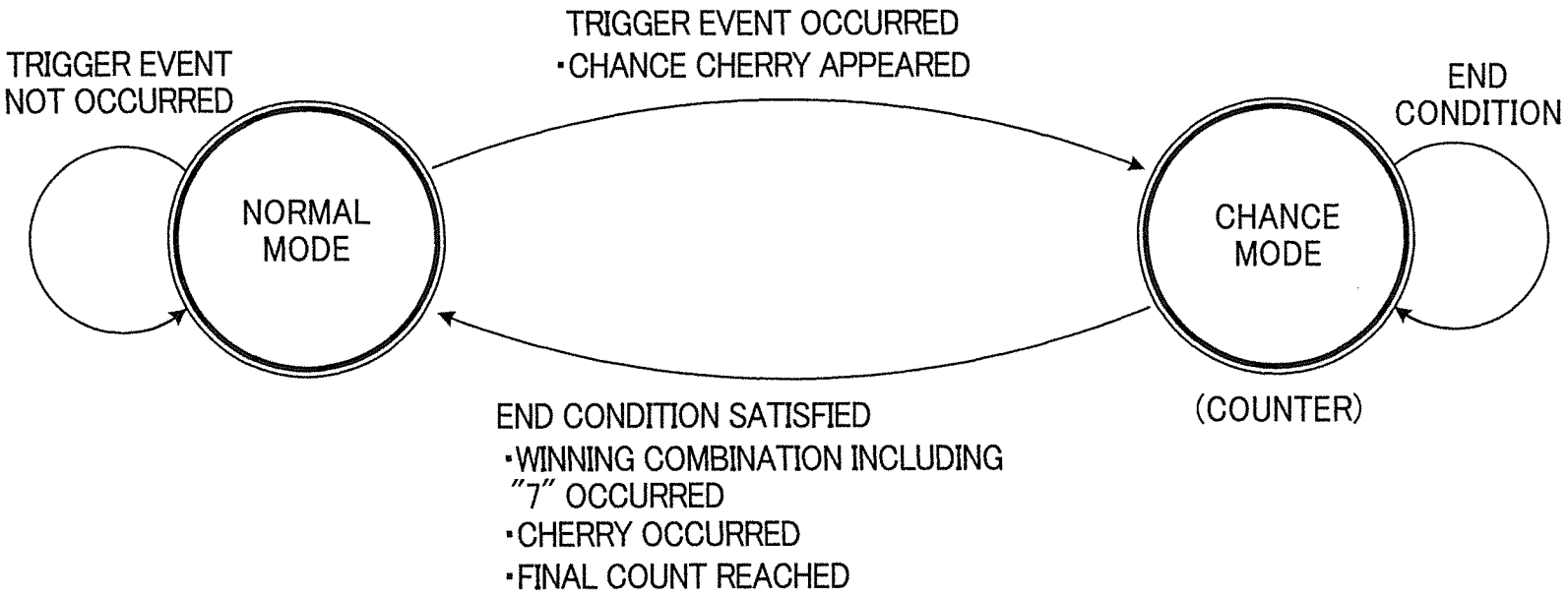
FIG. 23 is a diagram showing transitions of the state of the gaming machine related to the embodiment.

FIG. 23 is a diagram showing shifting of the states in the slot machine 10.

In the slot machine 10, the game mode is usually in the normal mode, and the normal mode is maintained unless a trigger event occurs. When a trigger event occurs during the normal mode, the game mode shifts to the chance mode. In the preferable embodiment, the trigger event is appearance of the "Chance Cherry" symbol at the second row in the third column of the symbol matrix.

When the game mode shifts to the chance mode, the slot machine 10 maintains the chance mode unless an end condition is satisfied. In an exemplary embodiment, one end condition is occurrence of one of winning combinations including a "7" symbol. Another example of the end condition is appearance of a "Cherry" symbol on one of the paylines in the symbol matrix formed by the rearranged symbols. After the game mode shifts to the chance mode, the slot machine 10 sets the game counter which counts up or counts down every time the unit game in the chance mode is run. A maximum number of unit games in the chance mode is 8 for one session of the chance mode. Here, the technical term "one session of the chance mode" means the period or the state starting from the time at which the game mode is shifted to the chance mode (i.e., the start of the chance mode) and ending at the end of the chance mode. Thus, when the value of the game counter reaches 8 as the result of counting up, or reaches 0 as the result of counting down, the slot machine 10 causes the "Cherry" symbol to appear in the symbol matrix formed by the rearranged symbols, or causes a winning combination including the "7" symbol to occur. This operation is done by, for example, repeating the process of determining the symbol combination until a symbol combination satisfying the end condition is obtained. When the end condition is satisfied, the game mode is returned to the normal mode, and the unit games are resumed in the normal mode.

(Symbol Code Determination Table and Payout Table)

In either game mode, the symbol combination (e.g., including a combination of symbols to be stopped) is determined based on a plurality of tables stored in the RAM 73 of the motherboard 70. As hereinabove described, the RAM 73 stores at least one of the symbol code determination tables and the symbol determination tables.

FIG. 24 shows an exemplary structure of the symbol code determination table.

The symbol code determination tables 340 to 348 each stores a mapping relation of the random numbers generated through the random number generating process P302 and the symbol codes of the symbols shown in FIG. 20. In other words, every time a random number is generated through the random number generating function 302, a symbol code corresponding to one symbol is determined, by referring to the symbol code determination tables 340 to 348, in the symbol determination process P304. When a range of random numbers is expanded, the symbol corresponding to that expanded range will be more likely determined. Further, when the entire range of the random numbers is expanded, it is possible to more accurately control the probabilities of the corresponding symbol codes being determined.

In the symbol code determination tables 340 to 348, the table 340 is used for determining the symbols in the normal mode, and the tables 341 to 348 are used for determining the symbols for a first to an eighth chance mode games.

When the first to fifth symbol arrays are different from one another, each of the symbol code determination tables 340 to 348 may be further divided into five tables corresponding to the symbol arrays, respectively. Further, as shown in FIG. 25, all the tables may be integrated into a single table having 45 data fields. This way, in the symbol determination process P304, one of the 45 data fields may be selectively used according to the game mode and the symbol array. In the present specification, each of the 45 data fields may be regarded as separate tables.

When two or more symbol arrays are identical to one another, a common symbol code determination table may be used to determine symbols for those symbol arrays. For example, in the example of FIG. 20, the second symbol array has the same symbol alignment as that of the fourth symbol array. Therefore, the symbol code determination table for the second symbol array may be used for determining the symbols of the fourth symbol array. Similarly, the first symbol array has the same symbol alignment as that of the fifth symbol array. Therefore, the symbol code determination table for the first symbol array may be used for determining the symbols of the fifth symbol array.

In the symbol determination process P304, when five symbols for one predetermined row (e.g., second row) of the symbol matrix are determined, and when all the symbols structuring the symbol matrix are determined, there is determined whether any of the winning combinations is formed. Then, the game mode of the subsequent unit games is determined in the game mode determination process P316.

FIG. 26 shows an exemplary symbol determination table. The symbol determination tables 360 to 368 regulate the probability of each symbol appearing on the payline. The symbol code determination tables 340 to 348 shown in FIG. 24 are determined based on the symbol determination tables 360 to 368. Of the symbol determination tables 360 to 368, the symbol determination table 360 is used for the normal mode, and the symbol determination tables 361 to 368 are used for the first to eighth chance mode games.

As in the case of the symbol code determination tables 340 to 348, each of the symbol determination tables 360 to 368 may be divided into five tables respectively corresponding to the symbol arrays. Further, all the tables may also be integrated into a single table having 45 data fields.

The probability of each symbol appearing on the payline affects the probability of a winning combination being formed. In other words, the symbol determination tables 360 to 368 may be generated based on the probability of the winning combination. The relation between the winning combinations and their probabilities can be arranged as in the case of the payout tables 380 to 388 shown in FIG. 27. The payout tables 380 to 388 each defines the payouts and the winning combinations. There are separate payout tables 380 to 388 for the normal mode game and the chance mode game. In particular, it is preferable to separately provide a payout table for use in the eight unit game in the chance mode. Of the payout tables 380 to 389, the payout table 380 may be used for the normal mode game, and the payout tables 381 to 388 may be used for the first to eighth chance mode games, respectively. All the payout tables 380 to 388 may be integrated into a single table.

Every time the unit game is run, there is determined if a winning combination is formed on any payline, in the winning determination process P310 in the game program which is executed by the main CPU 71. When a winning combination defined in the payout tables 380 to 388 is included in one of the paylines, that winning combination is detected and the amount of payout is checked, referring to the payout tables 380 to 388, in the winning determination process P310. The amount of payout determined is paid out in the payout process P314. When no winning combination is formed by the symbols appearing on the paylines, the result is determined as being so-called "lost".

For example, when three "7" symbols appear on symbol arrays, along any one of the paylines LINE1 to LINE5, a winning combination of three "7" symbols is formed and 200 times the bet amount is awarded as the payout. The benefit in the form of payout is awarded to the player by actually paying out coins to the coin tray 92, or by adding credit equivalent to the amount.

(Winning Probability in Chance Mode)

As hereinabove mentioned, when the "Chance Cherry" symbol appears at the second row in the third column of the symbol matrix, the game mode shifts to the chance mode and the chance mode is maintained until the end condition is satisfied. The end condition is formation of a winning combination including the "7" symbol, or appearance of the "Cherry" symbol on one of the paylines in the symbol matrix formed by the rearranged symbols.

When the game mode shifts to the chance mode, a counter is set in the counter process P306 shown in FIG. 19, which counts the number of unit games already played in the chance mode, or the number of unit games yet to be run in the chance mode. Then, a random number is generated in the random number generating process P302, and the symbols to be stopped are determined using the random number generated and with reference to the symbol code determination tables 341 to 348 in the symbol determination process P304. The symbol determination process P304 uses the symbol code determination table 341 for the first unit game in the chance mode. The symbol code determination tables are successively used with the progress of the chance mode games. When the eighth unit game (in the present embodiment, the last unit game in a session of the chance mode) of the chance mode is reached, and when the symbol combination (e.g., including combinations of symbols to be stopped) does not satisfies the end condition, the process of determining the symbol combination is repeated in the symbol determination process P304, until the symbol combination that satisfies the end condition is obtained.

The probability of a winning combination being formed differs depending on the symbol code determination tables 341 to 348. In particular, as the chance mode continues, the probability of a winning combination including a specific symbol being formed becomes higher. The symbol code determination tables 341 to 348 each has mapping data of the random numbers and symbol codes. The mapping data is such that a combination related to a specific symbol is more frequently formed as the chance mode continues.

The specific symbol in the present embodiment is the "7" symbol. That is, as the chance mode continues, the probability of the "7" symbol appearing in the symbol matrix or in a symbol combination becomes higher. The probability of the "7" symbol, i.e., the specific symbol, may be set higher than that of the normal mode. Further, it is possible to use another symbol such as "Cherry" symbol as another specific symbol. The following description assumes the "7" and "Cherry" both serve as a specific symbol.

FIG. 28 shows a table in which the probability of a winning combination related to the specific symbol is increasing. As shown in the table on the right side of FIG. 28, the probability of a winning combination including three "7" symbols increases as the chance mode game continues. In other words, the probability of the combination with three "7" symbols being formed in the second unit game is higher than that being formed in the first unit game. Further, that probability in the third unit game is higher than the same in the second unit game. As described, until the last (eighth) unit game is reached, the probability of the winning combination with three "7" being formed is gradually increased. The same goes to a winning combination with four "7" symbols, or with five "7" symbols.

As result, the total of the probability of the winning combination related to the "7" symbol being formed is increased as the chance mode game is repeated. In the example shown in the figure, the probabilities of the combinations with three "7" symbols, with four "7" symbols, and with five "7" symbols are 1/32.8, 1/67.2, and 1/672.0, respectively, in the first chance mode game. As described, the total probability of the combination related to the "7" symbol is 1/21.7(=1/32.8+1/67.2+1/672.0) in the first chance mode game. The total probability is raised to 1/18.7 in the second unit game, and raised to the 1/3.1 in the eighth unit game.

The same goes for the probability of the winning combination related to the "Cherry" symbol. To amuse the player, the total probability of the winning combination related to the "Cherry" symbol is set to zero for the first unit game, and is increased as the unit games are progressed. In particular, the total probability of the winning combination related to the "Cherry" symbol is 1/10.4 in the second unit game, and 1/6.6 in the third unit game. After the successive increase in the probability, the total probability of the winning combination related to the "Cherry" symbol reaches up to 1/1.5 in the eighth unit game.

The total probability of the winning combination related to the "Cherry" symbol and the "7" symbol is 1/21.7 in the first unit game. As described, the probability of the chance mode ending after the first unit game is approximately 4.61% (=1/21.7), and the probability of the chance mode being continued is 95.39% (=1-1/21.7).

The total probability of the winning combination related to the "Cherry" symbol and the "7" symbol is raised to 1/6.7 (=1/10.4+18.7) in the second unit game. Therefore, the probability of the chance mode ending after the second unit game is approximately 14.95% (=95.39%×1/6.7), and the probability of the chance mode being continued is 85.05% (=95.39%×(1-1/6.7)). The total probability of the winning combination related to the "Cherry" symbol and the "7" symbol is raised to 1/4.6(=1/6.6+15.1) in the third unit game. Therefore, the probability of the chance mode ending after the third unit game is approximately 21.73% (=85.05%×1/4.6), and the probability of the chance mode being continued is 78.27% (85.05%×(1-1/4.6)).

The total probability of the winning combination related to the "Cherry" symbol and the "7" symbol is raised to 1/1.0 (=1/1.5+3.1), in the last (eighth) unit game. Therefore, the probability of the chance mode ending after the eighth unit game is 100%. When the eighth unit game is reached, the random number generating process P302 and the symbol determination process P304 are repeated to repetitively generate random numbers and determine the symbols, until the winning combination is formed.

(Operation of Slot Machine)

The following describes an operation of the slot machine 10 with reference to FIG. 29 to FIG. 35.

Note that the following description assumes that one of a plurality of stop tables is randomly determined at the timing of pressing the start button, and the reels M3 are automatically stopped at a predetermined timing based on the stop table determined; however, the slot machine 10 is not limited to this. Specifically, the following structure is possible. Namely, the slot machine 10 has not-shown reel stop buttons corresponding to the reels M3, respectively, and randomly determines one of the stop tables at the timing of pressing the operation button. Based on that stop table determined and the timing of pressing the reel stop buttons, the reels M3 may be stopped. In other words, after the internal random determination of the stop table, the slot machine 10 may stop the reels M3 based on the timing of pressing the reel stop buttons and the stop table randomly determined internally, and then determine if there is a prize for any combinations of the symbols 501 stopped on all the reels M3.

Figure 29:
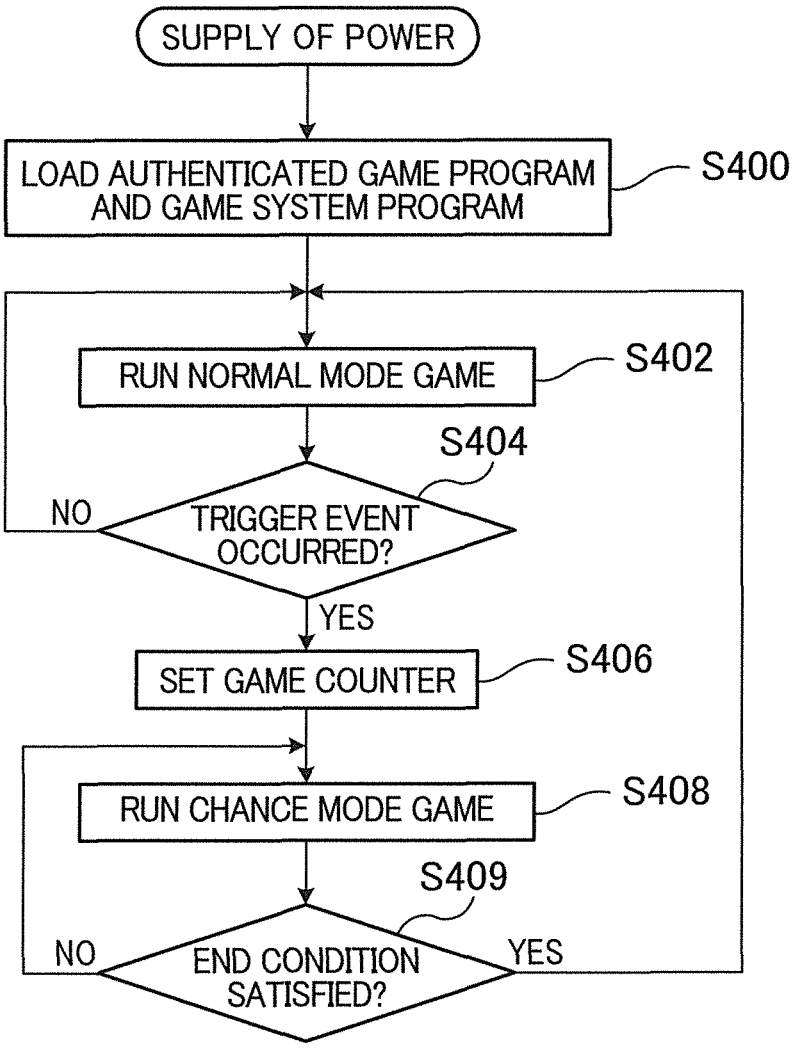
FIG. 29 is a flowchart showing an overall process executed in the gaming machine related to the embodiment.

FIG. 29 shows a process executed in the slot machine 10. When the power is supplied to the slot machine 10, the main CPU reads out the program from the memory card 54 via the gaming board 50, and writes the program into the RAM 73, thus loading the authenticated game program and the game system program (S400). Next, the main CPU 71 runs the game program and the game system program.

When the player starts a unit game by inserting an IC card into the IC card reader or entering a coin into a coin receiver, a new unit game is run based on the coin entered or the bet stored. The game mode of the unit game to be run first after the slot machine 10 is booted is the normal mode. As described, the main CPU 71 executes the normal mode game process for the first unit game (S402).

Every time the normal mode game ends, the main CPU 71 in the game mode determination process P316 determines whether a trigger event has occurred (S404). The game mode of the subsequent unit games is maintained in the normal mode, unless a trigger event has occurred. Thus, the main CPU 71 causes the process to return to step S402, and executes the normal mode game process for the subsequent unit games.

However, when the main CPU 71 determines that a trigger event has occurred in step S404 of the determination process, the CPU 71 changes the game mode of the subsequent unit game to the chance mode.

As hereinabove mentioned, in the preferable embodiment, the number of unit games run in a single session of the chance mode is 8. The symbol code determination tables 341 to 348 are different from one another, and are used for unit games of the chance mode, respectively. Every time the unit game of the chance mode is run, the game counter counts up the number of unit games already run in the session, or counts down the number of unit games remaining in the session. The following description assumes that the game counter counts up the number of unit games run, starting from zero. Therefore, the main CPU 71 sets the value of the game counter to zero in step S406. After that, the main CPU 71 executes the game process for the subsequent games in the chance mode (S408).

Every time the unit game in the chance mode ends, whether the end condition is satisfied is determined in the game mode determination process P316 (S409). Unless the end condition is satisfied, the game mode of the subsequent unit game is maintained in the chance mode. Therefore, the main CPU 71 causes the process to return to step S408, and executes the chance mode game process for the subsequent unit game.

When the main CPU 71 determines that the end condition is satisfied in the determination process of step S409, the CPU 71 switches the game mode of the subsequent unit game to the normal mode. Then, the main CPU 71 causes the process to return to step S402, and executes the normal mode game process for the subsequent unit game.

Figure 30:
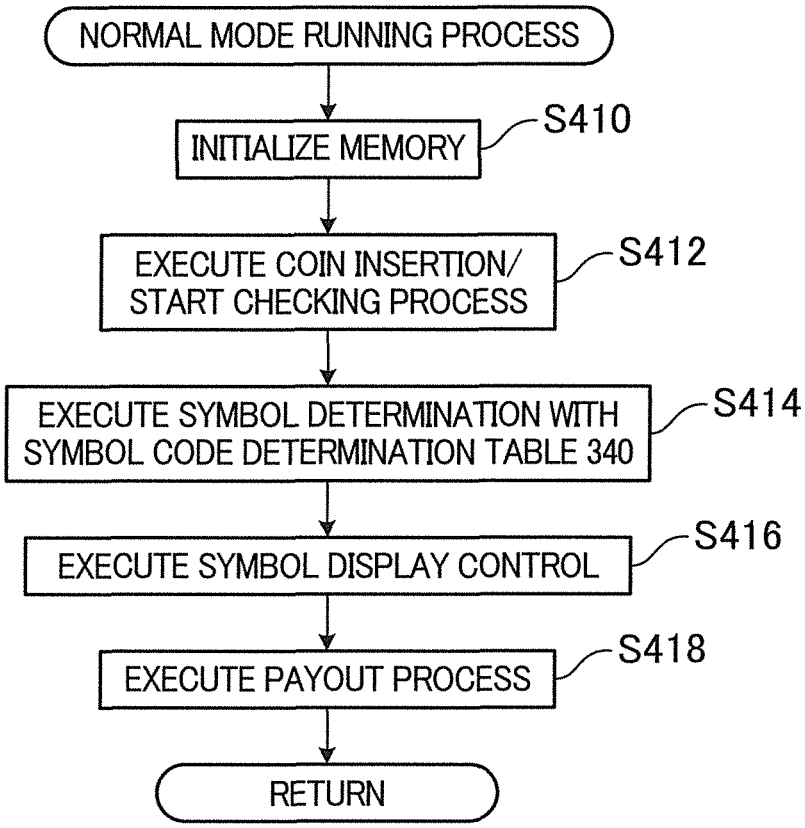
FIG. 30 is a flowchart showing a normal mode game process.

FIG. 30 shows the normal mode running process and shows the details of step S402 shown in FIG. 29.

Every time the unit game ends, the main CPU 71 executes a memory initializing process (S410). In this initializing process, the main CPU 71 clears unnecessary data and information from the temporary work area of the RAM 73. The unnecessary data and information include: payout data, information of winnings or loses, and information of symbols to be stopped which are determined in the previous unit game.

After that, the main CPU 71 executes a coin insertion/start checking process (S412). In this process, the main CPU 71 checks an insertion of a coin or a bill, and scans inputs from the BET button and the START button.

After the START button [spin button] is pressed by the player, the main CPU 71 executes the symbol determination process (S414). In this process, the main CPU 71 generates five random numbers, and determines, with reference to the symbol code determination table 340, five symbol codes of five symbols to be stopped according to the random numbers. The main CPU 71 determines whether the symbol matrix formed by the rearranged symbols includes any winning combination.

In step S416, the main CPU 71 executes the symbol display control process. In this process, the main CPU 71 controls the reel device M1 to rotate the reels M3 of the first to fifth reel assemblies M11*a* to M11*e*, and then stops the reels M3 to form a symbol matrix on the display window 150 by rearranging the symbols according to the result of the symbol determination process.

Next, the main CPU 71 in step S418 executes the payout process to determine the amount of payout, and award the amount of payout determined to the player.

(Symbol Determination Process)

Figure 31:
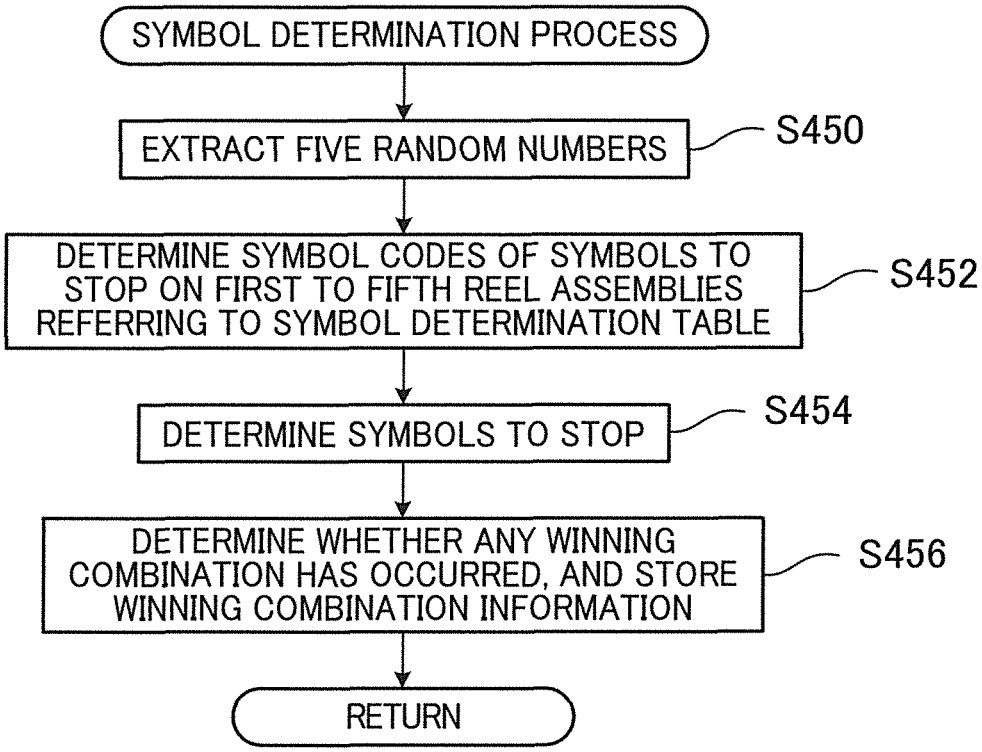
FIG. 31 is a flowchart showing details of a symbol determination process.

FIG. 31 shows the symbol determination process and shows the details of step S414 shown in FIG. 30.

First, in the random number generating process P302 executed by the main CPU 71, five random numbers are sampled (S450).

After that, in the symbol determination process P304 executed by the main CPU 71, the first to fifth symbol codes are determined by using the first to fifth random numbers, with reference to the symbol code determination table 340 (S452). Next, the main CPU 71 refers to the symbol code table and uses the first to fifth symbol codes to determine the first to fifth symbols to be stopped as shown in FIG. 20 (S454). Thus, the five symbols to be stopped are determined by using the five random numbers. After the first to fifth symbols to be stopped are determined, the main CPU 71 stores the symbols or the symbol codes in the RAM 73.

The five symbols to be stopped are the symbols to be stopped in the second row of the symbol matrix shown in FIG. 22. The alignment of the symbols structuring the first to fifth symbol arrays are fixed on the reels M3 of the first to fifth reel assemblies M11*a* to M11*e*. Therefore, determining these symbols to be stopped will determine all the symbols structuring the symbol matrix. The main CPU 71 refers to the symbol code table of FIG. 20, and determines all the symbols structuring the symbol matrix based on the symbols to be stopped (S456).

After that, in the winning determination process P310 executed by the main CPU 71, there is determined whether a winning combination is formed by the symbols determined in step S456, which structure the symbol matrix (S458). When a winning combination is formed by the symbols structuring the symbol matrix, the winning combination is stored in the RAM 73, in the winning determination process P310. Further, the main CPU 71 may determine whether a winning combination is formed based on the symbol codes of the symbols to be stopped, instead of using the symbol matrix for determining whether a winning combination is formed.

When the symbol determination process ends, the flow returns to the main process (not shown). Then, the symbol display control process is executed, and the reels M3 of the first to fifth reel assemblies M11*a* to M11*e* are rotated. The reels M3 of the first to fifth reel assemblies M11*a* to M11*e* rotate at different speed from one another, and the symbol arrays on the reels M3 of the reel device M1 scroll on the display window 150. While the reels M3 are rotating, the backlight units M7 is activated to provide an effect from the back of the reel bands M32. After this, the reels M3 of the first to fifth reel assemblies M11*a* to M11*e* are stopped. Through this, scrolling of the symbol arrays are stopped so that the symbols to be stopped are positioned in the second row of the symbol matrix formed on the display window 150.

When the symbol display control process ends, the process returns to the main process. Then, the payout process is executed. When a winning combination is formed, the amount of payout is determined according to the winning combination, and the amount determined is paid out in the form of increasing the credit or outputting of the coins.

(Chance Mode Running Process)

Figure 32:
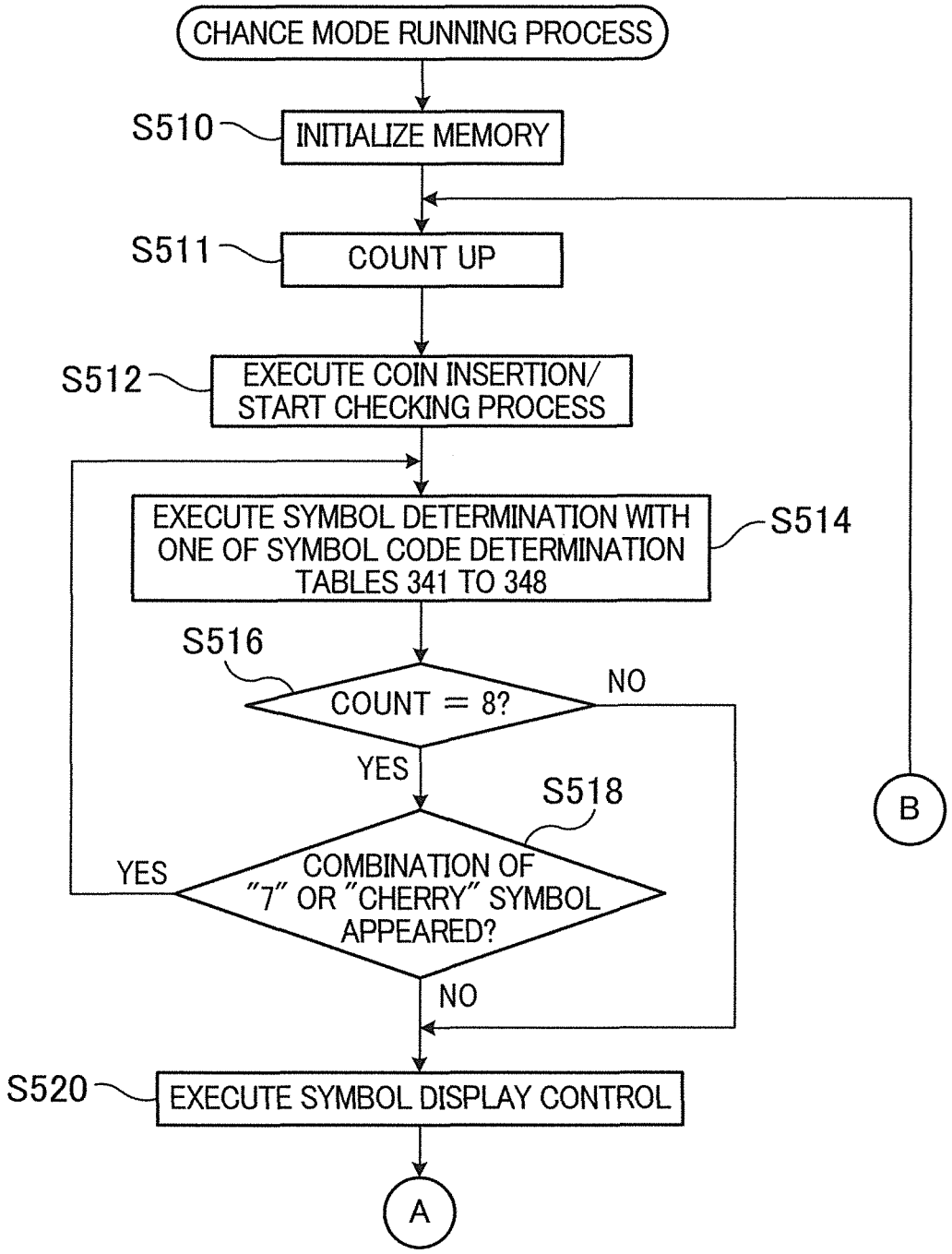
FIG. 32 is a flowchart showing a process of a chance mode game.
Figure 33:
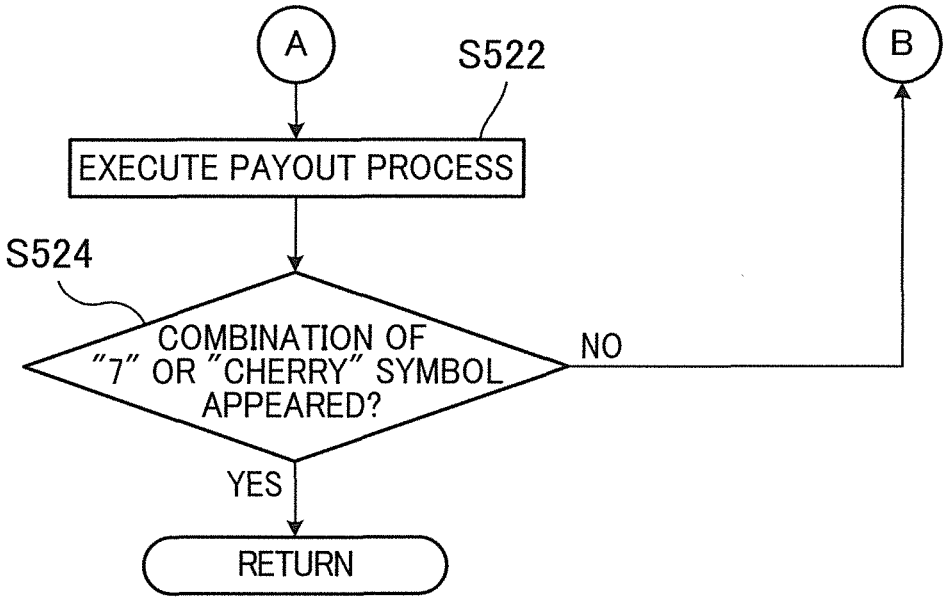
FIG. 33 is a flowchart showing a process of the chance mode game.

FIG. 32 and FIG. 33 show in detail the end condition determination process (S409) and the chance mode game process (S408) shown in FIG. 29.

When shifting to chance mode occurs, the main CPU 71 first executes the memory initializing process (S510). The main CPU 71 clears unnecessary data and information from the temporary work area of the RAM 73. The unnecessary data and information include: payout data, information of winnings or loses, and information of symbols to be stopped which are determined in the previous unit game.

Next, the main CPU 71 increments the counted number of the game counter indicating a serial number of the chance mode game run in step S511. Since the counted number of the game counter is initialized to 0, the counted number of the game counter is set to 1 for the first chance mode game.

Then, the main CPU 71 executes the coin insertion/start checking process (S512). In this process, the main CPU 71 checks for insertion of the coin or the bill, and detects an input signal from the BET button and the START button.

After the START button is pressed by the player, the main CPU 71 executes the symbol determination process (S514). In this process, the main CPU 71 generates five random numbers. Next in the symbol determination process P304 executed by the main CPU 71, the first to fifth random numbers are used to determine the first to fifth symbol codes, with reference to one of the symbol code determination tables 341 to 348. When the first chance mode game is run, the symbol code determination table 341 is used for determining the symbol codes. When the second chance mode game is run, the symbol code determination table 342 is used for determining the symbol codes. Similarly, when the other chance mode games are running, one of the symbol code determination tables 343 to 348 is successively used to determine the symbol codes.

After that, the main CPU 71 refers to the symbol code table shown in FIG. 20, and determines the first to fifth symbols to be stopped, which correspond to the first to fifth symbol codes, respectively. As the result, the five symbols to be stopped are determined by using the five random numbers. After the first to fifth symbols to be stopped are determined, the main CPU 71 stores the symbols or the symbol codes in the RAM 73.

Next, in the winning determination process P310 executed in the main CPU 71, there is determined whether a predetermined winning combination is formed by the rearranged symbols. If the predetermined winning combination is formed by the rearranged symbols, that winning combination is stored in the RAM 73, in the winning determination process P310.

The main CPU 71 checks if the value of the game count 324 has reached 8 (S516). This value of the game count 324 indicates that the last (eighth) chance mode game is running. When the game counted number has reached 8, the main CPU 71 determines whether the end condition is satisfied (S518). One end condition is formation of a winning combination including the "7" symbol. Another end condition is appearance of the "Cherry" symbol on a payline of the symbol matrix formed by the rearranged symbols.

When the value of the game count 324 reaches 8 and when there is no winning combination including the "7" symbol, or when no "Cherry" symbol appears on a payline of the symbol matrix formed by the rearranged symbols, the main CPU 71 causes the process to return to step S514, and repeats step S514. Through step S518, it is possible to cause the winning combination including the "7" symbol to appear, or cause the "Cherry" symbol to appear on a payline of the symbol matrix formed by the rearranged symbols.

On the other hand, in step S516, when the value of the game count 324 has not reached 8, when a winning combination including the "7" symbol is not formed in step S518, or when no "Cherry" symbol appears on the payline of the symbol matrix formed by the rearranged symbols, the process moves to step S520.

The main CPU 71 controls the reel device M1, and executes the symbol display control process to stop the rotation of the reels M3 of the first to fifth reel assemblies M11*a* to M11*e* (S520). The scrolling of the symbols is stopped according to the result of the symbol determination process, and the symbols are rearranged to form the symbol matrix on the display window 150. The main CPU 71 executes the payout process to determine the amount of payout, and provides the amount of payout determined to the player (S522).

The main CPU 71 again determines whether the end condition is satisfied (S524). When the end condition is satisfied, the main CPU 71 ends the chance mode gaming process. In step S524, if the end condition is not satisfied, the process returns to step S511, the value of the game count 324 is increased, and the chance mode is maintained to run the next unit game in the chance mode.

As hereinabove mentioned, the chance mode game continues, until a winning combination including the "7" symbol or the "Cherry" symbol appears on at least one of the paylines LINE1 to LINE5. It is possible to adopt a structure such that the main CPU 71 satisfies the end condition without fail, when the chance mode game is run a predetermined maximum number of times.

In a preferable embodiment, the probability of a winning combination including the "7" symbol appearing in the chance mode is higher than that in the normal mode. Specifically, as the chance mode continues, the probability of the winning combination including the "7" symbol appearing is gradually raised. This probability becomes 100% in the eighth chance mode game. The probabilities of other winning combinations may be lowered to some extent than the probabilities in the normal mode. The paylines LINE1 to LINE5 are preferably activated irrespective of the bet amount.

While the chance mode game is running as described above, the display state is in the show-through symbol display state as shown in FIG. 17, in which state the show-through symbols M332 are visible in areas other than the areas where the symbols 501 are displayed. In other words, in the normal mode, in which the chance mode game is not run, the display state is in the show-through symbol non-display state in which it is difficult to see the show-through symbols M332. The above state in which the show-through symbols M332 are visible reports that the game mode is in the chance mode.

Note that it is possible to report that the game mode is in the chance mode by means of visual and/or audio effect. Further, the chance mode may be reported by: making the backlights of the backlight units M7 brighter or darker than the normal mode; outputting a higher sound when the start button is operated; or making the pitch of the reel stop sound shorter.

(Light Application Control Process)

Figure 34:
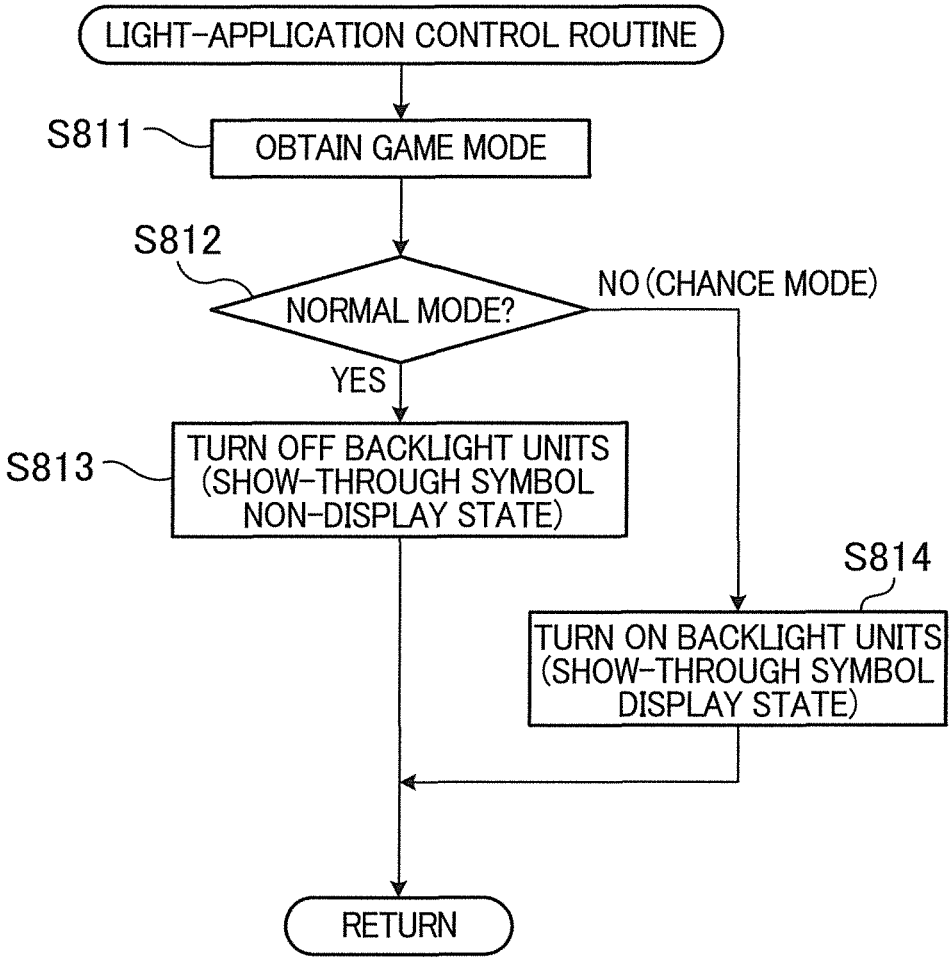
FIG. 34 is a flowchart of a light-application control routine.

With reference to the light-application control routine of FIG. 34, the following describes the light application control process which notifies of the type of the game mode. First, the type of the current game mode is obtained (S811). Next, whether the game mode is in the normal mode is determined (S812). When the game mode is in the normal mode (S812: YES), the backlight units M7 are turned off to create the show-through symbol non-display state on the display window 150, which state shows the game mode is in the normal mode (S813). As shown in FIG. 16, this causes the internal spaces M333 to be darker than the outside of the reel device M1, making it difficult to see the show-through symbols M332. Note that if the game mode is already in the normal mode before executing the step S812, this step may be skipped. Then, the present routine is ended.

When the game mode is not in the normal mode in the step S823 (S812: NO), the backlight units M7 are turned on to create the show-through symbol display state on the display window 150, which state shows the game mode is in the chance mode (S814). As shown in FIG. 17, this causes the internal spaces M333 to be lighter than the outside of the reel device M1, making it easier to see the show-through symbols M332. Note that if the game mode is already in the chance mode before executing the step S812, this step may be skipped. Then, the present routine is ended.

Figure 35:
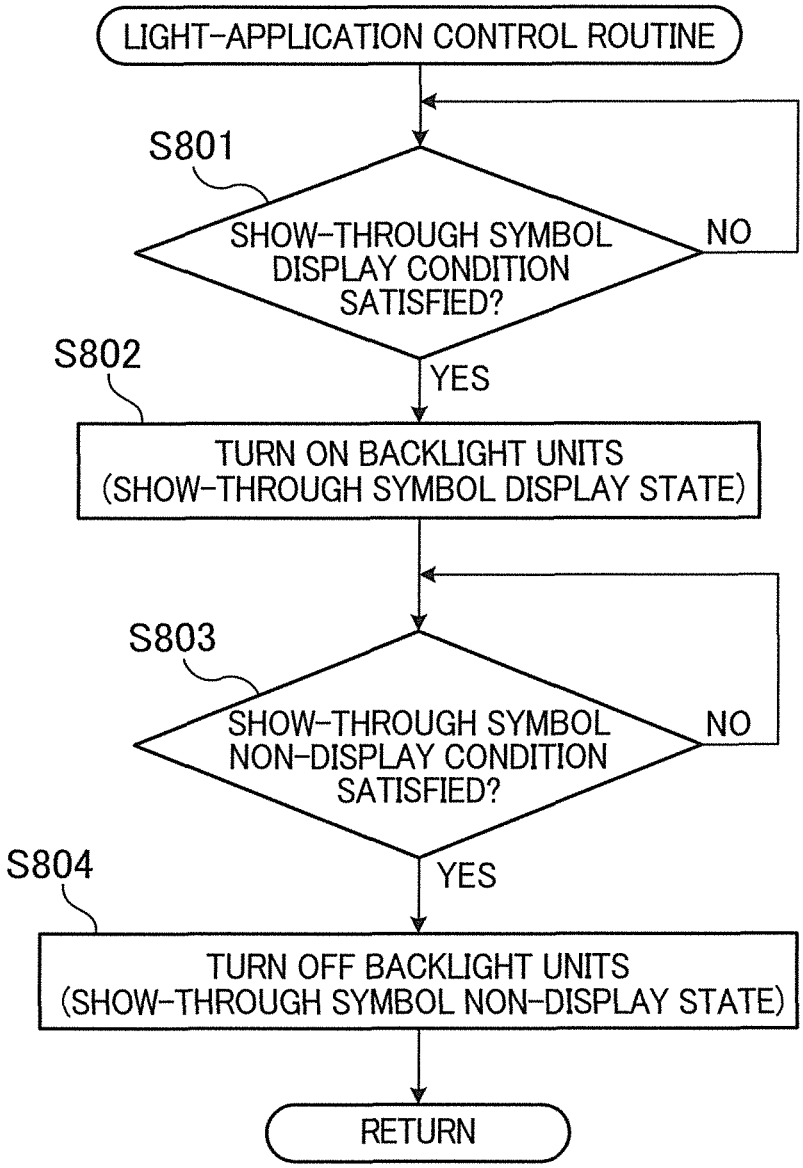
FIG. 35 is a flowchart of a light-application control routine.

Otherwise, the light application control process may be executed in the light-application control routine of FIG. 35. That is, first, it is determined whether a show-through symbol display condition is satisfied (S801). In the present embodiment, the show-through symbol display condition is a transition of the game mode to the chance mode. That is, the show-through symbol display condition is satisfied when it is determined that a trigger event has occurred in the process of determination for the occurrence of the trigger event in the step S404 described with reference to FIG. 29. When the show-through symbol display condition is not satisfied, that is, when the game mode is not in the chance mode (S801: NO), the present routine is ended. When the present routine is resumed at a predetermined timing, the process of determination in S801 is made.

Therefore, during the period in which the show-through symbol display condition is not satisfied (non-chance mode period), the free game and the basic game are run in the show-through symbol non-display state. Accordingly, the symbols 501 are displayed in columns throughout the display window 150. Note that the show-through symbol display condition may also be winning of a predetermined prize, starting of a predetermined type of game, or the like, in addition to the transition to the chance mode.

When the show-through symbol display condition is satisfied, i.e., when the game mode is in the chance mode (S801: YES), the backlight units M7 are turned on to create the show-through symbol display state on the display window 150, which state shows that the game mode is in the chance mode (S802).

This allows the player to see the show-through symbols M332 displayed on the display window 150, thereby to recognize that the current game is in the chance mode. Then, it is determined whether a show-through symbol non-display condition is satisfied (S804: NO). In the present embodiment, the show-through symbol non-display condition is the end of the chance mode. That is, the show-through symbol non-display condition is satisfied when it is determined that the end condition is satisfied in the process of step S409 for determining whether the end condition is satisfied, which process has been described with reference to FIG. 29. Unless the show-through symbol display condition is satisfied (S804: NO), the light application started in the S802 is continued. When the show-through symbol non-display condition is satisfied (S804: YES), the backlight units M7 are turned off to create the show-through symbol non-display state on the display window 150 (S804). Then, the present routine is ended.

When the show-through symbol non-display state is created by applying from the backlight units M7 the illuminating light having the same color or the same type color as that of the show-through symbols M332 to make it difficult to see the show-through symbols M332 as described above, the backlight units M7 are controlled so as to change the color of the illuminating light applied from the backlight units M7 in the step S813 and the step S804.

Further, when the show-through symbol non-display state is created by controlling the intensities of the outer and inner illuminating lights so that the outer illuminating light applied from the light application device R1 is greater than the inner illuminating light applied from the backlight units M7, the illuminating light of the backlight units M7 is decreased, or the illuminating light of the light application device R1 is increased, in the step S813 and the step S804.

Here, the timing for creating the show-through symbol display state and the timing for creating the show-through symbol non-display state may be individually set for the rotation and stopping of each reel M3, or may be set for the rotation and stopping of all the reels M3. Alternatively, the show-through symbol display state may be created while the reel M3 of the third reel assembly M11*c* is stopped.

As for the symbol display state, for example, in the case where the timings for creating the show-through symbol display state and the show-through symbol non-display state are set for the rotation and stopping of all the reels M3, a show-through symbol M332 is displayed in the area for a blank symbol after all of the reels M3 are stopped. In this case, the display on the display window 150 is changed after all the reels M3 are stopped. At this time, it is possible to switch back and forth between the display and non-display of the show-through symbol M332 by alternately turning on and off the backlight units M7.

The reason for changing the display on the display window 150 after all the reels M3 are stopped as is described above is that the symbols 501 are hard to be seen if the display on the display window 150 other than the symbols 501 is changed while the reels M3 are rotating.

The above embodiment thus described solely serves as a specific example of the present invention, and the present invention is not limited to such an example. Specific structures and various means may be suitably designed or modified. Further, the effects of the present invention described in the above embodiment are not more than examples of most preferable effects achievable by the present invention. The effects of the present invention are not limited to those described in the embodiments described above.

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A reel band comprising:

a translucent base layer;

a symbol layer laminated on an outer side of the base layer with respect to a direction of a thickness of the base layer to form a plurality of symbols; and a mesh pattern layer having rough texture and laminated on at least a portion of the base layer which portion is different from portions on which the symbols are formed when viewed from a direction in which the layer is laminated, the mesh pattern layer including a shield area configured to attenuate light applied thereto and a non-laminated area configured to pass therethrough light applied thereto.

2. The reel band according to claim 1, wherein the shield area of the mesh pattern layer is laminated by means of printing.

3. A gaming machine comprising:

a reel including the reel band recited in claim 2; and a controller configured to rotate and stop the reel to rearrange the symbols, thereby showing a game result.

4. A gaming machine comprising:

a reel including the reel band recited in claim 1; and a controller configured to rotate and stop the reel to rearrange the symbols, thereby showing a game result.

5. A reel assembly comprising:

a reel including a reel band having a plurality of symbols; and a backlight configured to illuminate the reel from an inside of the reel, wherein:

the reel band includes a translucent base layer, a symbol layer laminated on an outer side of the base layer with respect to a direction of a thickness of the base layer to form the symbols, and a mesh pattern layer having rough texture and laminated on a portion of the base layer which portion is different from portions on which at least the symbols are formed when viewed from a direction in which the layers are laminated, the mesh pattern layer including a shield area configured to attenuate light emitted from the backlight and a non-laminated area configured to pass therethrough light emitted from the backlight to an outside; and on an innermost layer of the reel band, there is provided a three dimensional recessed part including a translucent recessed member and a show-through symbol, the recessed member being formed to be recessed in cross-section, an inner wall surface of the recessed member creating an internal space in cooperation with the reel band, the show-through symbol being formed three-dimensionally on the inner wall surface.

6. A gaming machine comprising:

the reel assembly recited in claim 5; and a controller configured to rotate and stop the reel to rearrange the symbols, thereby showing a game result, and configured to control the backlight.

* * * * *